US009682834B2

(12) United States Patent
Kodama et al.

(10) Patent No.: US 9,682,834 B2
(45) Date of Patent: Jun. 20, 2017

(54) TRANSPORT APPARATUS

(71) Applicant: SEIKO EPSON CORPORATION, Tokyo (JP)

(72) Inventors: Hidetoshi Kodama, Matsumoto (JP); Kazuyoshi Ohashi, Matsumoto (JP); Toshikazu Kotaka, Shiojiri (JP); Kohei Ueno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/066,756

(22) Filed: Mar. 10, 2016

(65) Prior Publication Data

US 2016/0280495 A1 Sep. 29, 2016

(30) Foreign Application Priority Data

Mar. 27, 2015 (JP) ..... 2015-066985
Mar. 27, 2015 (JP) ..... 2015-066986
Mar. 27, 2015 (JP) ..... 2015-066987

(51) Int. Cl.
*B65H 3/66* (2006.01)
*B65H 29/12* (2006.01)
(Continued)

(52) U.S. Cl.
CPC ..... *B65H 3/66* (2013.01); *B41J 11/006* (2013.01); *B65H 29/125* (2013.01); *B65H 29/58* (2013.01);
(Continued)

(58) Field of Classification Search
CPC ..... B65H 15/00; B65H 29/60; B65H 37/00; B65H 37/04; B65H 2513/41; B65H 2801/24; B65H 2801/27; B65H 3/66; B65H 29/58; B65H 2801/15; B65H 2601/11; B65H 2301/4482; B65H 2301/44822;
(Continued)

(56) References Cited

U.S. PATENT DOCUMENTS 6,450,711 B1 * 9/2002 Conrow ..... B65H 15/00 400/582
8,596,637 B2 * 12/2013 Ogawa ..... B65H 5/26 271/264
(Continued)

FOREIGN PATENT DOCUMENTS

JP 2013-071833 4/2013
JP 2014-012413 1/2014

*Primary Examiner* — David H Bollinger
(74) *Attorney, Agent, or Firm* — Workman Nydegger

(57) ABSTRACT

A lead-in path through which a sheet is led in; a first branch path and a second branch path which branch from the lead-in path; a first switchback path which extends from the first branch path; a second switchback path which extends from the second branch path; a first joining path and a second joining path through which the switched-back sheet is transported; and a lead-out path which extends from a joining point at which the first joining path and the second joining path join with each other, are provided. The lead-out path passes through between the first switchback path and the second switchback path. A first connection point at which the first switchback path and the first joining path are connected to each other is disposed above a second connection point at which the second switchback path and the second joining path are connected to each other.

7 Claims, 13 Drawing Sheets

(51) Int. Cl.
*B41J 11/00* (2006.01)
*B65H 29/58* (2006.01)

(52) U.S. Cl.
CPC ..... *B65H 2301/33312* (2013.01); *B65H 2301/4482* (2013.01); *B65H 2301/44822* (2013.01); *B65H 2301/517* (2013.01); *B65H 2404/631* (2013.01); *B65H 2511/13* (2013.01); *B65H 2601/11* (2013.01); *B65H 2801/15* (2013.01); *B65H 2801/27* (2013.01)

(58) Field of Classification Search
CPC ..... B65H 2301/517; B65H 29/125; B65H 2404/631; B65H 2511/13; B65H 2301/33312; B41J 13/0036; B41J 13/009; B41J 11/006
USPC ..... 271/303
See application file for complete search history.

(56) References Cited

U.S. PATENT DOCUMENTS

| | | | | |
|---|---|---|---|---|
| 2002/0066995 | A1* | 6/2002 | Stoll | B65H 15/00 271/186 |
| 2009/0129840 | A1* | 5/2009 | Takekawa | B65H 29/60 399/407 |
| 2015/0002571 | A1* | 1/2015 | Kono | B41J 2/01 347/16 |
| 2016/0116881 | A1* | 4/2016 | Kodama | B65H 43/00 358/498 |

* cited by examiner

TRANSPORT APPARATUS

BACKGROUND

1. Technical Field

The present invention relates to a transport apparatus which transports a medium, such as a paper sheet.

2. Related Art

In the related art, a printing apparatus (recording apparatus) which prints (records) an image, such as a character or a picture, by making ink which is an example of liquid adhere onto a paper sheet which is an example of a medium, and a printing system (recording system) which reverses a posture of the paper sheet with respect to a paper sheet on which printing is performed by the printing apparatus, and which is provided with a transport apparatus which is an example of an external apparatus that transports the paper sheet, are known. For example, JP-A-2013-71833 discloses a printing system which is provided with a printing apparatus, a transport apparatus, and a post-processing apparatus which is an example of an external apparatus that is connected to the transport apparatus and that performs post-processing, such as cutting or stapling with respect to the paper sheet on which the printing is performed.

The transport apparatus of JP-A-2013-71833 includes an approach path through which the paper sheet is transported from the printing apparatus to the transport apparatus, a reverse path which reverses the paper sheet transported through the approach path, and a discharge path which discharges the paper sheet reversed by the reverse path to the post-processing apparatus. In other words, in the transport apparatus, when the paper sheet is transported from the printing apparatus via the approach path, the paper sheet is discharged from the discharge path to the post-processing apparatus after reversing the paper sheet by the reverse path.

The printing apparatus of JP-A-2013-71833 includes a normal path through which the paper sheet on which the printing has been completed is transported toward a paper feeding tray provided in the printing apparatus, and a communication path through which the paper sheet is transported toward the transport apparatus. In other words, in the printing apparatus, the paper sheet on which the printing is performed is transported through any one of the paths among the curved normal path toward the paper feeding tray and the communication path that extends along a horizontal direction toward the transport apparatus.

The transport apparatus of JP-A-2013-71833 can be reduced in the size since there is one reverse path, but there is a difficulty in improving the processing speed of the paper sheet.

SUMMARY

An advantage of some aspects of the invention is to provide a transport apparatus which can improve the processing speed of a medium and suppress an increase in the size of the apparatus.

The occurrence of paper jamming of the paper sheet in the middle of the path when the paper sheet is transported (discharged) along the path is generally a common problem in a recording apparatus (printing apparatus) including a printer. In the printing apparatus of JP-A-2013-71833, when the paper jamming of the paper sheet occurs further on a downstream side than a recording portion, in order to solve the problem, a configuration in which an opening is provided on a front surface of the apparatus and the paper jamming is released by inserting a hand from the opening and pulling out the jammed paper sheet is considered. However, in this configuration, there is a case where the transport path through which the paper sheet is transported is not exposed and it is difficult to pull out the paper sheet.

An advantage of some aspects of the invention is to provide a recording system which can easily remove a medium when eliminating the transport failure of the medium in a recording apparatus, and a recording apparatus which configures the same.

In a case where printing is performed with respect to a medium which has a large amount of rigidity and does not require post-processing, such as a thick paper sheet, in order to avoid the transport failure, such as paper jamming, in the middle of the path through which the medium is transported, it is preferable that the medium is transported through a path having a small curve. In other words, in a case of the printing apparatus of JP-A-2013-71833, when transporting the thick paper sheet, the paper sheet is transported through the communication path which extends in a horizontal direction, and a medium is loaded on the post-processing apparatus via the transport apparatus. In this case, there is a concern that the thick paper sheet which does not require the post-processing is transported through a long path, and the transport time becomes unnecessarily long.

An advantage of some aspects of the invention is to provide a recording system including a recording apparatus which can shorten the transport time with respect to a medium that has a large amount of rigidity and does not require post-processing, even in a case where a post-processing apparatus which performs the post-processing with respect to the medium is attached.

According to an aspect of the invention, there is provided a transport apparatus including: a housing which includes a plurality of switchback paths; a lead-in path through which a medium is led into the housing; a first branch path and a second branch path which branch in directions different from each other from a branch point which becomes a downstream end of the lead-in path in a transport direction in which the medium led in from the lead-in path is transported; a guiding portion which guides the medium by selectively switching the medium that is transported through the lead-in path to be transported to any one of the first branch path and the second branch path; a first switchback path which is provided to extend downward in a vertical direction from the downstream end of the first branch path, and in which the medium is switched back; a second switchback path which is provided to extend downward in a vertical direction from the downstream end of the second branch path, and in which the medium is switched back; a first joining path through which the medium switched back by the first switchback path is transported; a second joining path through which the medium switched back by the second switchback path is transported; and a lead-out path which extends from a joining point at which the downstream end of the first joining path and the downstream end of the second joining path join with each other, in which the lead-out path is provided to pass through between the first switchback path and the second switchback path and extend in order to detour the downstream end of the first switchback path, in which a first connection point at which an upstream end of the first switchback path and an upstream end of the first joining path are connected to each other is disposed above a second connection point at which an upstream end of the second switchback path and an upstream end of the second joining path are connected to each other in the vertical direction, and in which a downstream side in the second switchback path is configured of a guide portion provided on the bottom surface of the housing and in the housing.

The transport apparatus configured as described above is provided with two switchback paths which switch back the medium in order to improve the processing speed of the medium led in from the lead-in path. In addition, when considering that the post-processing apparatus which performs the post-processing with respect to the medium is connected to the transport apparatus, in order to increase a loading amount of the medium in the post-processing apparatus, it is preferable that the downstream end of the lead-out path through which the medium is led out extends upward in the vertical direction. Therefore, since the lead-out path is configured to extend in order to detour the downstream end of the first switchback path, there is a concern that the dimension of the transport apparatus in the vertical direction increases. Here, the first connection point to which the upstream end of the first switchback path is connected is provided at a position which is above the second connection point to which the upstream end of the second switchback path is connected in the vertical direction. According to this configuration, since the downstream end of the first switchback path is pulled up in the vertical direction, it is possible to suppress the height dimension of the transport apparatus in the vertical direction, even in the configuration in which the lead-out path extends to detour the downstream end of the first switchback path. Therefore, it is possible to suppress an increase in the size of the apparatus while improving the processing speed of the medium.

In the transport apparatus, the first connection point may be positioned below the branch point in the vertical direction.

In this configuration, it is possible to suppress an increase in the size of the transport apparatus since the first connection point to which the upstream end of the first switchback path is connected is positioned above the branch point in the vertical direction.

In the transport apparatus, the lead-in path may be provided to diagonally extend to intersect the vertical direction.

In this configuration, it is possible to make the first branch path and the second branch path relatively easily branch from the downstream end of the lead-in path.

In the transport apparatus, the lead-in path may be provided to include a position which is above the housing in the vertical direction to penetrate the inside and the outside of the housing.

In this configuration, since it is possible to shorten the length of the lead-in path when the first switchback path and the second switchback path that extend downward in the vertical direction are provided, it is possible to improve the degree of freedom of the shape of the path in the housing.

In the transport apparatus, the downstream end of the lead-out path may extend toward a side opposite to the side on which the lead-in path penetrates the housing, and the first connection point and the second connection point may be positioned near the downstream end of the lead-out path with respect to the branch point.

In this configuration, compared to a configuration in which the second connection point is positioned near the lead-in path with respect to the branch point, it is possible to suppress an increase in the size of the apparatus in the vertical direction.

In the transport apparatus, an opening portion may be formed at a part of a side wall of the housing.

In this configuration, since a user can insert a hand into the housing from the opening portion, it is possible to eliminate the transport failure of the medium in the transport apparatus.

In the transport apparatus, the second switchback path may extend to pass through a lower part of the path which is positioned at the lowermost part of the downstream path, in the vertical direction.

In this configuration, compared to a configuration in which the second switchback path is provided to extend along the vertical direction, since it is possible to make the downstream end dive into the lower part of the downstream path in the vertical direction, it is possible to suppress an increase in the size of the apparatus.

According to another aspect of the invention, there is provided a recording system including: a recording apparatus which includes a housing, a recording portion which is accommodated in the housing, and records an image on a medium, a discharge path through which the medium on which recording is performed by the recording portion is transported, and a pull-out unit which configures at least a part of the discharge path and can be pulled out from the housing; a transport apparatus which includes an intermediate path through which the medium that passed through the discharge path is transported, and which includes a switchback path through which the medium is switched back; and a post-processing apparatus which receives the medium that passed through the intermediate path and performs the post-processing onto the medium, in which a moving region of the pull-out unit when the pull-out unit is pulled out is configured to avoid the transport apparatus and the post-processing apparatus.

In this configuration, since the moving region when the pull-out unit provided in the recording apparatus is pulled out is configured to avoid the transport apparatus and the post-processing apparatus, it is possible to easily remove the medium when eliminating the transport failure of the medium in the recording apparatus.

In the recording system, in a state before the pull-out unit is pulled out, in the housing, when viewed from a width direction which intersects the transport direction of the medium, an opening portion may be formed at a position of which at least a part overlaps the pull-out unit.

In this configuration, when the transport failure of the medium occurs in the recording apparatus, the transport failure of the medium is eliminated by pulling out the pull-out unit from the housing, but there is a case where the medium remains in the housing, although it is rare. Therefore, the opening portion is provided in the housing. According to the configuration, when the discharge failure of the medium occurs, even when the medium remains in the housing, it is possible to easily eliminate the transport failure of the medium as the user inserts the hand from the opening portion.

In the recording system, the discharge path may include a curved reverse path through which the medium is transported in a curved posture, and a part of the curved reverse path may be configured of a path forming portion provided to be rotatable with respect to the pull-out unit.

In this configuration, since the inside of the path of the curved reverse path is opened by rotating the path forming portion, it is possible to easily eliminate the transport defect of the medium.

In the recording system, the pull-out unit may have a configuration in which an axis which is a rotation fulcrum of the path forming portion can be pulled out to a position exposed from the housing.

In this configuration, by sufficiently pulling out the pull-out unit, when rotating the path forming portion, it is possible to suppress a concern that the path forming portion interferes with the housing and the curved reverse path is not opened.

According to still another aspect of the invention, there is provided a recording apparatus to solve the above-described problem including: a housing; a recording portion which is accommodated in the housing, and records an image on a medium; an upstream discharge path through which the medium on which recording is performed by the recording portion is transported; an upper discharge path which branches from a branch position which becomes a downstream end of the upstream discharge path in the transport direction in which the medium is transported, and transports the medium toward an upper part of the housing; a lower discharge path which branches from the branch position, and transports the medium toward a lower part of the housing; a switching guiding portion which is provided at the branch position, and guides the medium by selectively switching the medium that is transported through the upstream discharge path to be transported to any one of the upper discharge path and the lower discharge path; and a pull-out unit which is provided to be capable of being pulled out from the housing together with the switching guiding portion.

In this configuration, the pull-out unit which is pulled out from the housing is configured to be capable of being pulled out from the housing together with the switching guiding portion provided at the branch position at which the transport failure easily occurs. Therefore, it is possible to easily remove the medium when eliminating the transport failure of the medium in the recording apparatus.

In the recording apparatus, in a state before the pull-out unit is pulled out, in the housing, when viewed from a width direction which intersects the transport direction of the medium, an opening portion may be formed at a position of which at least a part overlaps the pull-out unit.

In this configuration, it is possible to achieve operation effects similar to operation effects achieved by the above-described recording system.

In the recording apparatus, the upper discharge path may include a curved reverse path through which the medium is transported in a curved posture, and a part of the curved reverse path may be configured of a path forming portion provided to be rotatable with respect to the pull-out unit.

In this configuration, it is possible to achieve the operation effects similar to the operation effects achieved by the above-described recording system.

In the recording apparatus, the pull-out unit may have a configuration in which an axis which is a rotation fulcrum of the path forming portion can be pulled out to a position exposed from the housing.

In this configuration, it is possible to achieve the operation effects similar to the operation effects achieved by the above-described recording system.

According to still another aspect of the invention, there is provided a recording apparatus to solve the above-described problem including: a housing; a recording portion which is accommodated in the housing and records an image on a medium; an upstream discharge path through which the medium on which recording is performed by the recording portion is transported; an upper discharge path which branches from a branch position which becomes a downstream end of the upstream discharge path in the transport direction in which the medium is transported, and transports the medium toward an upper part of the housing; a lower discharge path which branches from the branch position, and transports the medium toward a lower part of the housing; a switching guiding portion which is provided at the branch position, and guides the medium by selectively switching the medium that is transported through the upstream discharge path to be transported to any one of the upper discharge path and the lower discharge path; and a rotation unit which can expose the switching guiding portion to the outside of the housing when being rotated with respect to the housing together with the switching guiding portion.

In this configuration, as the rotation unit, which rotates away from the housing, rotates with respect to the housing together with the switching guiding portion provided at the branch position at which the discharge failure easily occurs, the switching guiding portion is exposed to the outside of the housing. Therefore, it is possible to easily remove the medium when eliminating the transport failure of the medium in the recording apparatus.

According to still another aspect of the invention, there is provided a recording system to solve the above-described problem including: a recording portion which performs recording onto a medium; a supply path through which the medium is transported toward the recording portion; an upstream discharge path through which the medium on which recording is performed by the recording portion is transported; a non-reverse discharge path which branches from a branch position which is a downstream end of the upstream discharge path in a transport direction in which the medium is transported, and through which the medium is transported while a posture of the medium in a vertical direction is not reversed; a loading portion which loads the medium discharged by the non-reverse discharge path; a lower discharge path which branches and extends downward in the vertical direction from the branch position; a post-processing apparatus which receives the medium that passed through the lower discharge path and performs post-processing with respect to the medium; and a switching guiding portion which guides the medium by selectively switching the medium on which the recording is performed by the recording portion to be transported to any one of the non-reverse discharge path and the lower discharge path.

In this configuration, for example, in a case where the recording is performed with respect to the medium which has a large amount of rigidity and which does not require the post-processing, such as a thick paper sheet, and in the recording apparatus, the non-reverse discharge path through which the medium is transported while the posture of the medium in the vertical direction is not reversed is provided. Due to this, it is not necessary to transport the medium toward the post-processing apparatus via the lower discharge path. Therefore, even in a case where the post-processing apparatus which performs the post-processing with respect to the medium is attached, it is possible to shorten the transport time with respect to the medium which has a large amount of rigidity and does not require the post-processing.

In the recording system, an upper discharge path which branches upward in the vertical direction from the branch position, and through which the medium on which the recording is performed by the recording portion is transported while being curved may be further provided, and the non-reverse discharge path may be positioned between the lower discharge path and the upper discharge path and extend.

In this configuration, since the non-reverse discharge path linearly extends, it is possible to reduce a concern that the transport failure occurs, even in a case where the medium having a large amount of rigidity is transported.

In the recording system, a housing which accommodates at least the recording portion and the upstream discharge path, and a pull-out unit which configures at least a part of the upper discharge path and can be pulled out from the housing along the transport direction in which the medium is transported, may be provided.

In this configuration, by pulling out the pull-out unit which configures at least a part of the upper discharge path from the housing, it is possible to eliminate the transport failure of the medium which occurs on the upper discharge path.

In the recording system, in the housing, when viewed from the width direction which intersects both the transport direction in which the medium is transported and the vertical direction, an opening portion may be formed at a position further on the downstream side than the recording portion in the transport direction.

In this configuration, as the user inserts the hand into the housing from the opening portion, it is possible to eliminate the transport failure of the medium in the housing.

In the recording system, the loading portion may have a rising shape which extends so that a tip end which becomes a downstream side in the transport direction in which the medium is transported is above a base end which becomes an upstream side in the vertical direction.

In this configuration, it is possible to reduce a concern that the medium which has already been loaded on the loading portion falls when being pushed out by the medium transported through the non-reverse discharge path.

In the recoding system, a transport apparatus which includes an intermediate path through which the medium which passed through the lower discharge path is transported toward the post-processing apparatus may further be provided, and the intermediate path may include a switchback path which switches back the medium.

In this configuration, as the transport apparatus including the intermediate path is provided, it is possible to gain the transport time during which the medium that requires post-processing is transported. In other words, by gaining the transport time of the medium, it is possible to suppress a curve generated on the medium due to the recording by the recording portion.

In the recording system, the switchback path may have a curved path.

In this configuration, it is possible to store the switchback path within a relatively small space while ensuring the length of the switchback path in the transport direction in which the medium is transported.

In the recording system, the loading portion may have a rising shape which extends so that the tip end which becomes the downstream side in the transport direction in which the medium is transported is above the base end which becomes the upstream side in the vertical direction, may have a part which overlaps the intermediate path in the vertical direction when viewed from the width direction that intersects both the transport direction in which the medium is transported and the vertical direction, and may be disposed avoiding the highest part of the intermediate path in the vertical direction due to the rising shape.

In this configuration, while ensuring the rising shape of the loading portion, it is possible to transport the medium to the post-processing apparatus at a high position in the vertical direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording system provided with a transport apparatus will be described with reference to the drawings.

Figure 1:
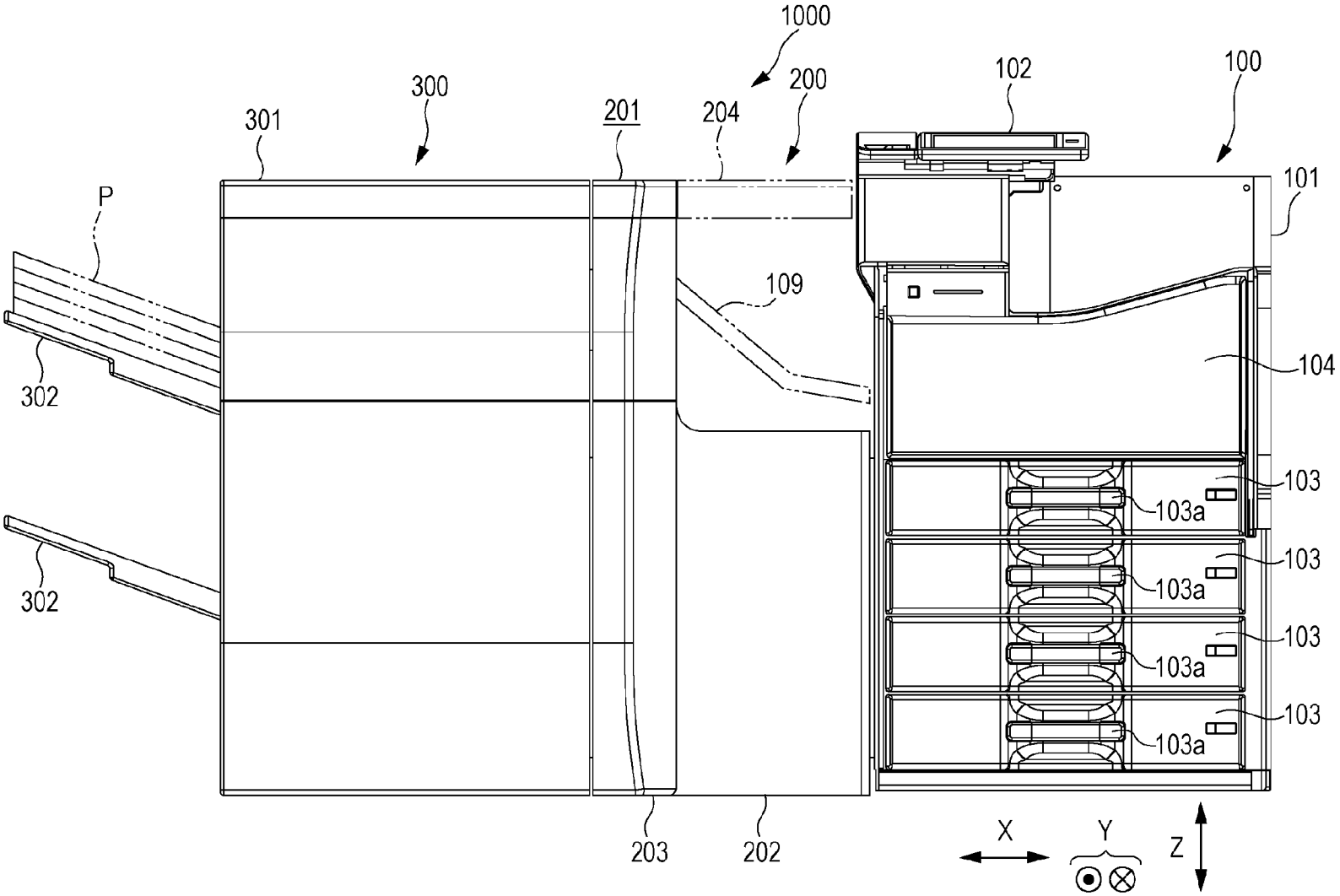
FIG. 1 is a front view illustrating an external appearance of an embodiment of a recording system provided with a transport apparatus.
Figure 2:
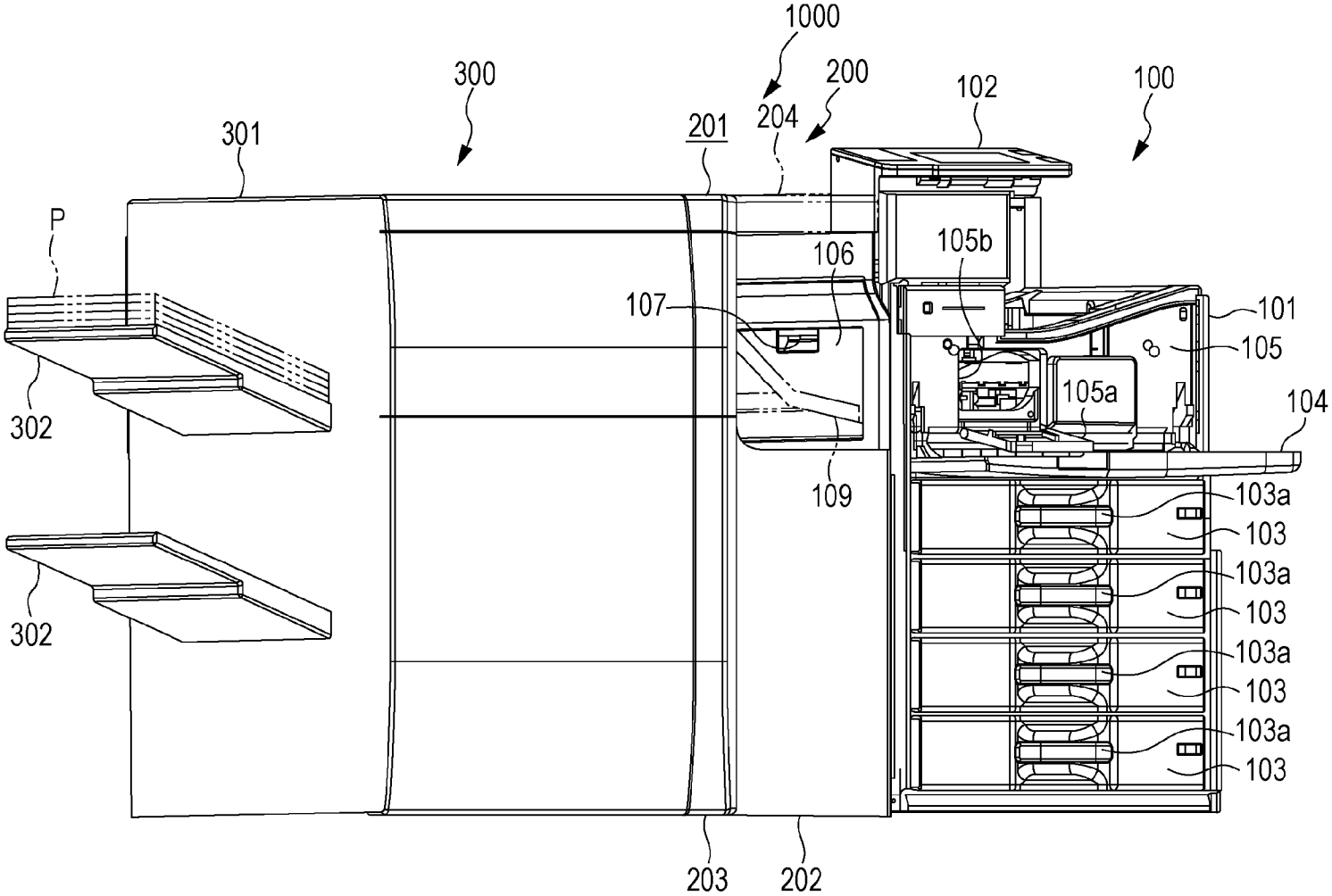
FIG. 2 is a perspective view illustrating an external appearance of the recording system when a front plate cover of a printer is opened.

As illustrated in FIGS. 1 and 2, a recording system 1000 is configured to include a printer 100 which is an example of a recording apparatus that performs recording on a medium, and a transport apparatus 200 which is an example of an external apparatus that transports a paper sheet P which is an example of the medium. In the embodiment, a post-processing apparatus 300 which is an example of the external apparatus that performs the post-processing on the paper sheet P is also further included. The recording system 1000 is configured by disposing the printer 100, the transport apparatus 200, and the post-processing apparatus 300 to be aligned in order from a right side to a left side in a leftward-and-rightward direction X in FIG. 1. In other words, in the embodiment, the leftward-and-rightward direction X which becomes a transport direction of the paper sheet P on which the recording is performed is considered an alignment direction, the printer 100 and the transport apparatus 200 are adjacent to each other, the transport apparatus 200 and the post-processing apparatus 300 are adjacent to each other, and the transport apparatus 200 is interposed between the printer 100 and the post-processing apparatus 300.

The printer 100 is an ink jet type printer which records an image, such as a character or a picture, by making ink which is an example of liquid adhere onto the paper sheet P which is an example of the medium, and includes a recording apparatus side housing 101 having a rectangular parallelopiped shape. In a vertical direction Z, an operation portion 102 for performing various operations of the printer 100 is attached to an upper portion of the recording apparatus side housing 101.

In the printer 100, in the vertical direction Z, a paper cassette 103 is provided across a lower portion from a center portion of the printer 100. In the embodiment, four paper cassettes 103 are disposed being aligned in the vertical direction Z, and the paper sheets P onto which the printer 100 performs the recording are accommodated in a stacked state in each of the paper cassettes 103. In addition, in the center portions in the leftward-and-rightward direction X in the paper cassettes 103, grip portions 103*a* which can be gripped by a user are respectively formed. In other words, the paper cassette 103 is configured to be insertable into the recording apparatus side housing 101 in a forward-and-rearward direction Y which intersects both the leftward-and-rightward direction X and the vertical direction Z. In addition, the paper sheets P accommodated in each paper cassette 103 may be different types from each other, and may be the same type.

In the vertical direction Z, at a position adjacent to the uppermost paper cassette 103, a rectangular front plate cover 104 is provided. The front plate cover 104 is provided to be rotatable by using a long side adjacent to the paper cassette 103 as a base end, and is configured to be freely rotated between two positions, that is, an open position at which a tip end side, which becomes a side opposite to the base end, is separated from the printer 100, and a closed position which configures a part of the recording apparatus side housing 101. When the front plate cover 104 is at the open position, a part of a frame 105 which configures the printer 100 is exposed. In the frame 105, a rectangular frame cover 105*a* having a smaller area than that of the front plate cover 104 is provided. Similar to the front plate cover 104, the frame cover 105*a* is configured to be freely rotated between the open position and the closed position by using one side that becomes a lower side in the vertical direction Z as the based end. When the frame cover 105*a* is at the open position, an opening portion 105*b* formed in the frame 105 is exposed. The opening portion 105*b* is opened in the frame 105 to the extent that the user can insert the hand therein.

In the printer 100, on a left side surface which is a surface to which the transport apparatus 200 is attached and which is a surface on a left side in the leftward-and-rightward direction X, a pull-out surface portion 106 which configures a part of a side wall of the recording apparatus side housing 101 and can be pulled out from the recording apparatus side housing 101 is provided. In the upper portion in the vertical direction Z in the pull-out surface portion 106, a handle portion 107 which the user can hook the hand is formed. When the pull-out surface portion 106 is pulled out from the recording apparatus side housing 101 along the pulling-out direction which is oriented leftward in the leftward-and-rightward direction X, being interlocked with this, a pull-out unit 170 which will be described later is pulled out from the recording apparatus side housing 101 (refer to FIGS. 8 and 9).

Figure 3:
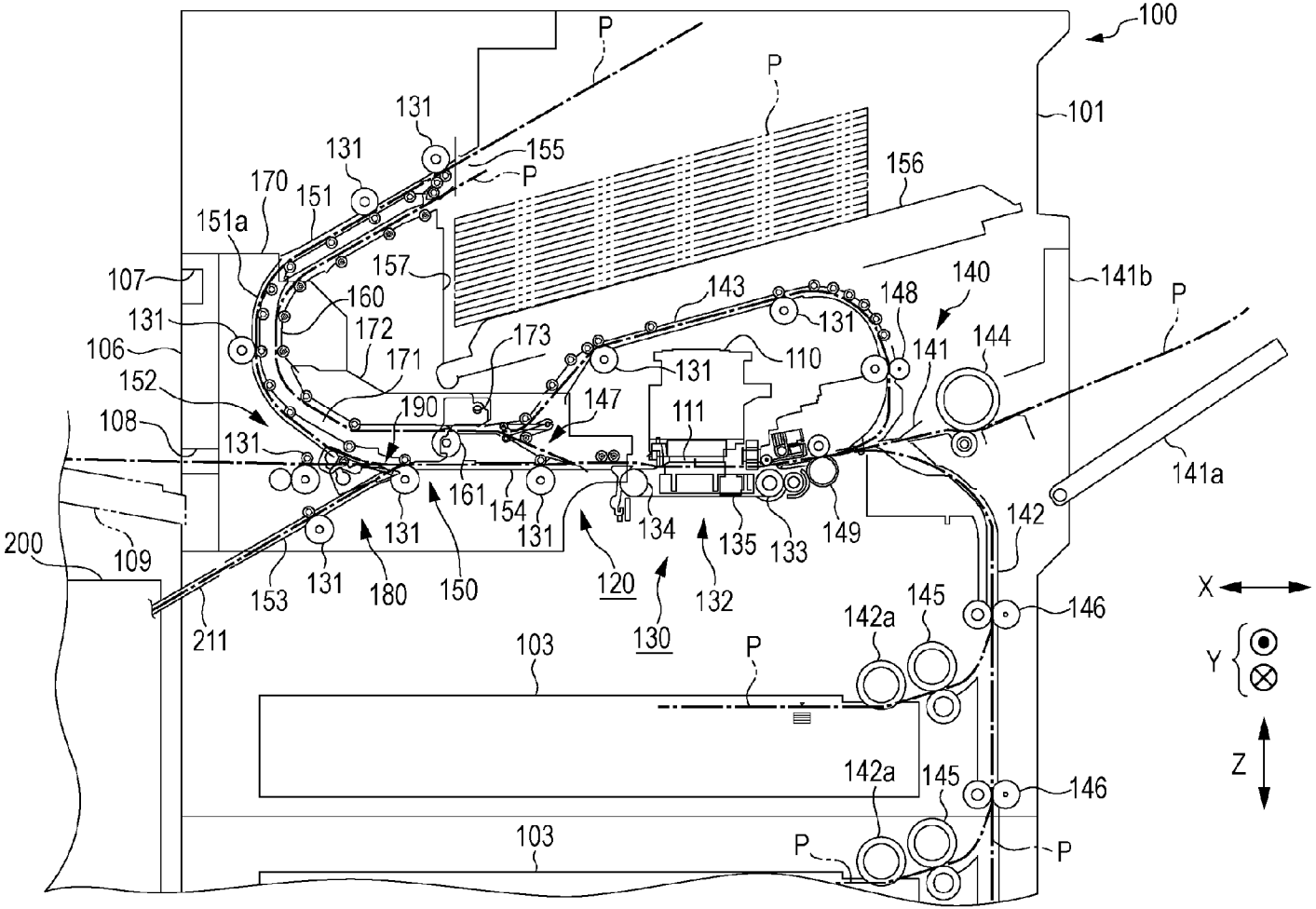
FIG. 3 is a schematic structure view of the printer.

In addition, as illustrated in FIG. 3, in the pull-out surface portion 106, at a position which becomes the lower side in the vertical direction Z in the handle portion 107, a discharge port 108 which discharges the paper sheet P on which the recording is performed is formed. In addition, further on the lower side, a paper feeding tray (loading portion) 109 which extends leftward in the leftward-and-rightward direction X is provided to be attachable as necessary. In other words, the paper sheet P discharged via the discharge port 108 is loaded on the paper feeding tray 109. In addition, the paper feeding tray 109 is configured to be attachable to and detachable from the pull-out surface portion 106, and has a shape (that is, a rising shape) of a rising gradient (inclined upward left in FIG. 3) which is inclined upward when approaching the tip end that becomes the side opposite to the base end, from the base end which is connected to the pull-out surface portion 106.

Returning to FIGS. 1 and 2, in the leftward-and-rightward direction X which is an alignment direction, the transport apparatus 200 attached to a left side surface of the printer 100 includes a transport apparatus side housing (housing) 201 having a rectangular parallelopiped shape. The transport apparatus side housing 201 includes a lead-in portion 202 which leads in the paper sheet P on which the recording is performed by the printer 100, and a lead-out portion 203 which is positioned further on the left side (downstream side in the transport direction) in the leftward-and-rightward direction X than the lead-in portion 202, and leads out the paper sheet P to the post-processing apparatus 300. The lead-in portion 202 is provided to be larger than the lead-out portion 203 in the leftward-and-rightward direction X, and is provided to be smaller than the lead-out portion 203 in the vertical direction Z.

In addition, in a state where the lead-in portion 202 is disposed being aligned with the printer 100 in the leftward-and-rightward direction X, the lead-in portion 202 is provided so that the height of the lead-in portion 202 is between an upper portion of the uppermost paper cassette 103 and a lower portion of the pull-out surface portion 106, which are provided in the printer 100, in the vertical direction Z, and the height of the lead-out portion 203 is substantially the same as that of the printer 100. In other words, in a state where the lead-in portion 202 is attached to the adjacent printer 100 in the leftward-and-rightward direction X, the height of the lead-in portion 202 is low in the vertical direction Z so as not to interfere with the movement of the pull-out surface portion 106 in a pulling-out direction. In addition, in the upper portion of the lead-out portion 203, a plate-shaped top plate portion 204 which extends rightward in the leftward-and-rightward direction X is provided to be attachable as necessary, so as to face the printer 100 side. The top plate portion 204 is formed at a position higher than the upper portion of the pull-out surface portion 106 in the vertical direction Z, and is configured not to interfere with the movement of the pull-out surface portion 106. Furthermore, the paper feeding tray 109 positioned below the top plate portion 204 is provided to avoid the lead-out portion 203 by a curved rising shape thereof.

In the leftward-and-rightward direction X which is the alignment direction, the post-processing apparatus 300 attached to the left side surface of the transport apparatus 200 includes a post-processing apparatus side housing 301 having a rectangular parallelopiped shape. The post-processing apparatus 300 performs post-processing with respect to the paper sheet P on which the recording is performed by the printer 100 and which is transported by the transport apparatus 200. Examples of the post-processing include cutting, folding, punching, and stapling. In addition, the paper sheet P, to which the post-processing is performed, is loaded on a stacker (two in the embodiment) 302 which extends leftward from the left side surface of the post-processing apparatus 300.

Next, a structure of the printer 100 will be described.

As illustrated in FIG. 3, in the recording apparatus side housing 101 provided in the printer 100, a recording portion 110 which performs the recording from the upper side in the vertical direction Z onto the paper sheet P, and a transport portion 130 which transports the paper sheet P along a transport path 120 are provided. The transport path 120 is formed so that the paper sheet P is transported by considering a direction that intersects a width direction as the transport direction, when a direction along the forward-and-rearward direction Y is considered the width direction of the paper sheet P.

The recording portion 110 is provided with a line head type recording head 111 which can dispense the ink at the same time across substantially the entire region of the paper sheet P in the width direction, at a lower part thereof. The recording portion 110 forms an image on the paper sheet P as the ink dispensed from the recording head 111 and adheres to a recording surface (a surface on which the image is printed) which opposes the recording head 111 on the paper sheet P.

The transport portion 130 includes a plurality of transport roller pairs 131 which are disposed along the transport path 120, and a belt transport portion 132 which is provided immediately below the recording portion 110. In other words, with respect to the paper sheet P transported by the belt transport portion 132, the ink is dispensed from the recording head 111 and the recording is performed.

The belt transport portion 132 includes a driving roller 133 which is disposed further on the upstream side than the recording head 111 in the transport direction; a driven roller 134 which is disposed further on the downstream side than the recording head 111 in the transport direction; and an endless circular belt 135 which is wound around each of the rollers 133 and 134. The belt 135 revolves as the driving roller 133 is driven to be rotated, and the paper sheet P is transported to the downstream side by the revolving belt 135. In other words, an outer circumferential surface of the belt 135 functions as a supporting surface which supports the paper sheet P on which the recording is performed.

The transport path 120 includes a supply path 140 through which the paper sheet P is transported toward the recording portion 110; a discharge path 150 through which the paper sheet P on which the recording is performed and the recording has been completed by the recording portion 110 is transported; and a branch path 160 which branches from the discharge path 150.

The supply path 140 includes a first supply path 141, a second supply path 142, and a third supply path 143. In the first supply path 141, the paper sheet P inserted from an insertion port 141*b* which is exposed by opening a cover 141*a* provided on the right side surface of the recording apparatus side housing 101, is transported to the recording portion 110. In other words, the paper sheet P inserted from the insertion port 141*b* is linearly transported toward the recording portion 110 as a first driving roller pair 144 is driven to be rotated.

In the second supply path 142, the paper sheets P which are accommodated in each of the paper cassettes 103 provided in the lower portion of the recording apparatus side housing 101 are transported to the recording portion 110 in the vertical direction Z. In other words, among the paper sheets P accommodated in a stacked state on the paper cassettes 103, the uppermost paper sheet P is sent out by a pickup roller 142*a*, and the paper sheets P are separated one by one by a separation roller pair 145. Then, while reversing the posture in the vertical direction Z, the paper sheets P are transported toward the recording portion 110 as a second driving roller pair 146 is driven to be rotated.

In the third supply path 143, in a case where duplex printing which records the image on both surfaces of the paper sheet P is performed, the paper sheet P on which the recording has been completed on one surface by the recording portion 110 is transported to the recording portion 110 again. In other words, further on the downstream side than the recording portion 110 in the transport direction, the branch path 160 which branches from the discharge path 150 is provided. In other words, when performing the duplex printing, the paper sheet P is transported to the branch path 160 by an operation of a branch mechanism 147 provided in the middle of the discharge path 150. In addition, in the branch path 160, a branch path roller pair 161 which can rotate both normally and reversely is provided further on the downstream side than the branch mechanism 147.

When performing the duplex printing, the paper sheet P of which one surface is printed is guided to the branch path 160 by the branch mechanism 147, and is transported to the downstream side in the branch path 160 by the branch path roller pair 161 which normally rotates. After this, the paper sheet P transported to the branch path 160 is reversely transported to the upstream side from the downstream side in the branch path 160 by the branch path roller pair 161 which reversely rotates. In other words, the transport orientation of the paper sheet P transported through the branch path 160 is reversed.

The paper sheet P which is reversely transported from the branch path 160 is transported to the third supply path 143, and is transported toward the recording portion 110 by the plurality of transport roller pairs 131. As the paper sheet P is transported through the third supply path 143, the paper sheet P is reversed so that the other surface which is not printed opposes the recording portion 110, and is transported toward the recording portion 110 as a third driving roller pair 148 is driven to be rotated. In other words, the third supply path 143 functions as a reverse transport path which transports the paper sheet P while reversing the posture of the paper sheet P in the vertical direction Z.

Among the supply paths 141, 142, and 143, the second supply path 142 and the third supply path 143 transport the paper sheet P toward the recording portion 110 while making the posture of the paper sheet P curved in the vertical direction Z. Meanwhile, compared to the second supply path 142 and the third supply path 143, the first supply path 141 transports the paper sheet P toward the recording portion 110 without making the posture of the paper sheet P largely curved.

After the paper sheet P transported through each of the supply paths 141, 142, and 143 is transported to an aligning roller pair 149 installed further on the upstream side than the recording portion 110 in the transport direction, a tip end thereof abuts against the aligning roller pair 149 which stopped rotating. In addition, inclination of the paper sheet P with respect to the transport direction is corrected (skew removing) by the state where the paper sheet P abuts against the aligning roller pair 149. After this, the paper sheet P of which the inclination is corrected is transported to the recording portion 110 in an aligned state as the aligning roller pair 149 is driven to be rotated.

The paper sheet P on which the recording is performed on one surface or on both surfaces by the recording portion 110 and the recording has been completed, is transported along the discharge path 150 which configures the downstream portion of the transport path 120 by the transport roller pair 131. The discharge path 150 branches to a first discharge path 151, a second discharge path 152, and a third discharge path 153 at a position which is further on the downstream side than the position of branching from the branch path 160. In other words, the paper sheet P on which the recording has been completed is transported through a common discharge path (upstream discharge path) 154 which configures the upstream portion of the discharge path 150. After this, the paper sheet P on which the recording has been completed is guided to any path among each of the first to the third discharge paths (downstream discharge paths) 151, 152, and 153 which configure the downstream portion of the discharge path 150, by a guiding mechanism (switching guiding portion) 180 which is provided at a downstream end of the common discharge path 154.

The first discharge path (upper discharge path) 151 is provided to be oriented toward the upper part of the recording apparatus side housing 101, and to extend being curved along the branch path 160. The paper sheet P transported through the first discharge path 151 is discharged from a discharge port 155 which is opened at a part of the recording apparatus side housing 101 to be a terminal end of the first discharge path 151. In addition, the paper sheet P discharged from the discharge port 155 falls to the lower side in the vertical direction Z, and is fed to a loading table 156 in a stacked state, as illustrated by two-dot chain line in FIG. 3. In addition, by the transport roller pairs 131 disposed at a plurality of locations of the discharge path 150, the paper sheet P is fed to the loading table 156 in a posture that the recording surface faces downward in the vertical direction Z when simplex printing is performed, from the discharge port 155.

The loading table 156 has a shape inclined to ascend forward, which rises to the upper side in the vertical direction Z when approaching in a rightward direction in the leftward-and-rightward direction X, and the paper sheets P are loaded in the stacked state on the loading table 156. At this time, each paper sheet P loaded on the loading table 156 moves in a leftward direction along the inclination of the loading table 156, and is loaded being close to a vertical side wall 157 provided on the lower side of the discharge port 155 of the recording apparatus side housing 101.

In addition, the first discharge path 151 includes a curved reverse path 151*a* which reverses front and rear surfaces of the paper sheet P while the paper sheet P on which the recording is performed by the recording portion 110 is transported to the discharge port 155. In other words, the curved reverse path 151*a* makes the paper sheet P curved by considering the recording surface of the paper sheet P on which the recording is performed by the recording portion 110 as an inner side, and reverses the paper sheet P from a state where the recording surface of the paper sheet P is oriented to the upper side in the vertical direction Z, in the vertical direction Z, to a state where the recording surface is oriented to the lower side in the vertical direction Z. Therefore, in the discharge path 150, the paper sheet P is discharged from the discharge port 155 in a state where the recording surface faces the loading table 156 when the simplex printing is performed as the paper sheet P passes through the curved reverse path 151*a*.

The second discharge path 152 branches further to the lower side than the first discharge path 151 in the vertical direction Z, and linearly extends toward the pull-out surface portion 106 which configures a part of the recording apparatus side housing 101 from the recording portion 110. Therefore, the paper sheet P transported through the second discharge path 152 is not transported in a curved posture similar to the first discharge path 151, is linearly transported while constantly maintaining the posture similar to the posture when the paper sheet P passes through the recording portion 110, and is discharged to the paper feeding tray 109 attached to the pull-out surface portion 106 from the discharge port 108 formed in the pull-out surface portion 106. In other words, the second discharge path 152 functions as a non-reverse discharge path which transports the paper sheet P toward the paper feeding tray 109 without reversing the posture of the paper sheet P in the vertical direction.

The third discharge path (lower discharge path) 153 branches further to the lower side than the second discharge path 152 in the vertical direction Z, and extends toward the lower side being inclined in the vertical direction Z so as to be oriented toward the lower part of the recording apparatus side housing 101. In addition, the downstream end is connected to the upstream end of a lead-in path 211 provided in the transport apparatus 200 in the recording apparatus side housing 101. In other words, the paper sheet P transported through the third discharge path 153 is discharged to the transport apparatus 200.

A part of the discharge path 150 and a part of the branch path 160 are attached to the pull-out unit 170 provided in the recording apparatus side housing 101. The pull-out unit 170 is connected to the pull-out surface portion 106 and is capable of being integrally handled. Therefore, the pull-out unit 170 is pulled out from the recording apparatus side housing 101 by pulling out the pull-out surface portion 106, and is exposed from the recording apparatus side housing 101.

A first path forming portion 171 which configures a part of a guide surface on a curved inner side of the first discharge path 151 and a part of a guide surface on a curved outer side of the branch path 160, and a second path forming portion 172 which configures a part of the guide surface on the curved inner side of the branch path 160, are attached to the pull-out unit 170 to be rotatable around an axis 173 provided in the pull-out unit 170. In other words, in a state where the pull-out unit 170 is pulled out, as each of the path forming portions 171 and 172 rotates in a clockwise direction in FIG. 3 around the axis 173, the inner portions of the branch path 160 and the first discharge path 151 are exposed (refer to FIGS. 8 and 9).

Figure 4:
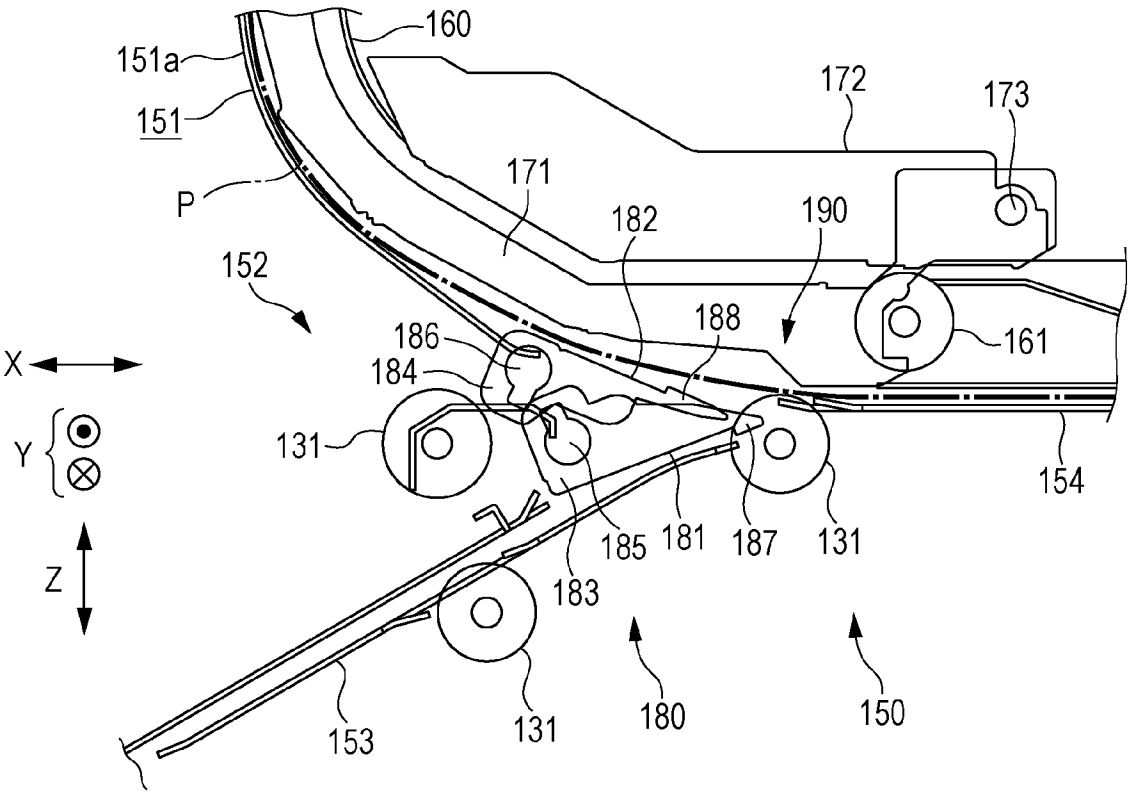
FIG. 4 is an enlarged view illustrating a guiding mechanism.
Figure 5:
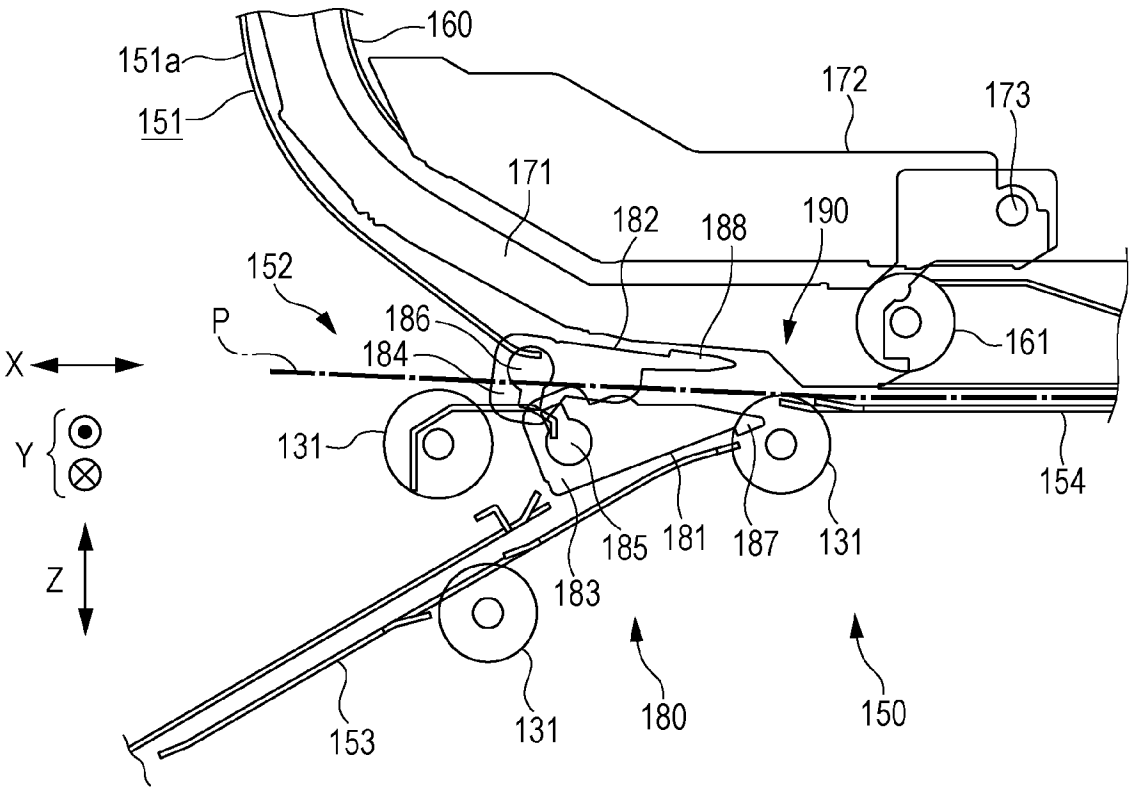
FIG. 5 is an enlarged view illustrating the guiding mechanism.
Figure 6:
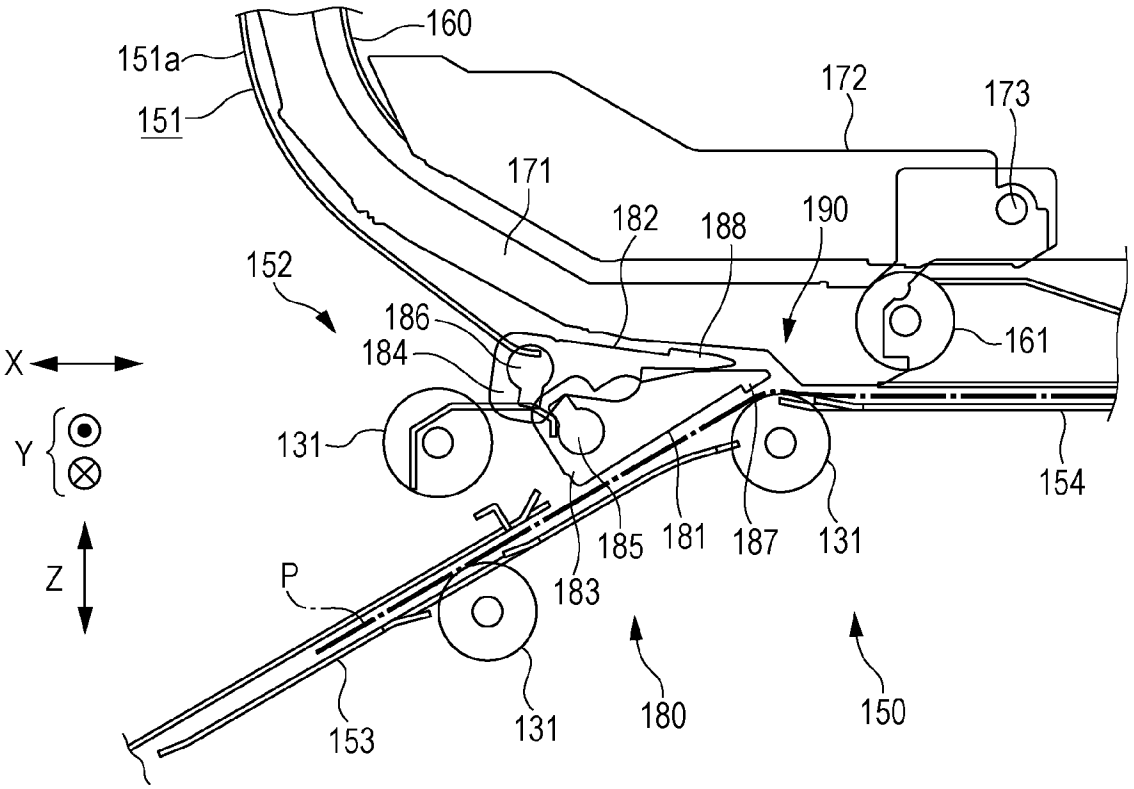
FIG. 6 is an enlarged view illustrating the guiding mechanism.

As illustrated in FIGS. 4 to 6, the guiding mechanism 180 includes a first guiding portion 181 and a second guiding portion 182. Each of the guiding portions 181 and 182 is provided at a branch position 190 which branches to each of the first to the third discharge paths 151, 152, and 153 from the downstream end of the common discharge path 154, and is disposed to be deviated in the leftward-and-rightward direction X which is the transport direction of the paper sheet P from the recording portion 110 so that the first guiding portion 181 is positioned on the right side which is the upstream side and the second guiding portion 182 is positioned on the left side which is the downstream side. In addition, even in the vertical direction Z, the guiding mechanism 180 is disposed to be deviated so that the first guiding portion 181 is positioned on the lower side and the second guiding portion 182 is positioned on the upper side.

In addition, each of the guiding portions 181 and 182 respectively includes axes 185 and 186 in base end portions 183 and 184 which are a part on the left side that becomes the downstream side in the leftward-and-rightward direction X which is the transport direction, and is provided to be rotatable around each of the axes 185 and 186. Each of the guiding portions 181 and 182 is a part on the right side which becomes the upstream side in the leftward-and-rightward direction X which becomes the transport direction as the guiding portions 181 and 182 rotate around the axes 185 and 186 which are respectively provided in the guiding portions, and positions of tip end portions 187 and 188 which are on a side opposite to the base end portions 183 and 184 are displaced up and down in the vertical direction Z. In other words, each of the guiding portions 181 and 182 is provided to be freely rotated between two positions, that is, an upper position at which each of the tip end portions 187 and 188 positioned on the upstream side in the transport direction of the paper sheet P is near the first path forming portion 171, and a lower position at which the tip end portions 187 and 188 are separated from the first path forming portion 171. Meanwhile, as illustrated in FIG. 4, the tip end portion 187 of the first guiding portion 181 is positioned further on the upstream side than the tip end portion 188 of the second guiding portion 182 in the transport direction of the paper sheet P.

In other words, each of the guiding portions 181 and 182 is respectively selectively switched up and down, comes into contact with the paper sheet P transported through the common discharge path 154, and accordingly, guides the paper sheet P to any of the first to the third discharge paths 151, 152, and 153. Meanwhile, each of the guiding portions 181 and 182 is configured not to interrupt the rotation operation each other, for example, not to interfere with each other since the guiding portions 181 and 182 are formed in a shape of comb teeth across the tip end portions 187 and 188 from the base end portions 183 and 184. In addition, the rotation operations in each of the guiding portions 181 and 182 are controlled by a control portion which is provided in the printer 100 and is not illustrated.

FIG. 4 is a view when any of the tip end portion 187 of the first guiding portion 181 and the tip end portion 188 of the second guiding portion 182 is positioned at the lower position. At this time, the tip end portion 187 of the first guiding portion 181 is positioned to block the upstream end of the third discharge path 153, and the tip end portion 188 of the second guiding portion 182 is positioned to block the upstream end of the second discharge path 152. In other words, in the state of FIG. 4, the guiding mechanism 180 guides the paper sheet P transported through the common discharge path 154 to the first discharge path 151.

FIG. 5 is a view when the tip end portion 187 of the first guiding portion 181 is positioned at the lower position, and the tip end portion 188 of the second guiding portion 182 is positioned at the upper position. At this time, the tip end portion 187 of the first guiding portion 181 is positioned to block the upstream end of the third discharge path 153, and the tip end portion 188 of the second guiding portion 182 is positioned to block the upstream end of the first discharge path 151. In other words, in the state of FIG. 5, the guiding mechanism 180 guides the paper sheet P transported through the common discharge path 154 to the second discharge path 152.

FIG. 6 is a view when any of the tip end portion 187 of the first guiding portion 181 and the tip end portion 188 of the second guiding portion 182 is positioned at the upper position. At this time, the tip end portion 187 of the first guiding portion 181 is positioned to block the upstream end of the first discharge path 151 and the upstream end of the second discharge path 152, and the tip end portion 188 of the second guiding portion 182 is positioned to block the upstream end of the first discharge path 151. In other words, in the state of FIG. 6, the guiding mechanism 180 guides the paper sheet P transported through the common discharge path 154 to the third discharge path 153.

Next, the transport apparatus 200 will be described.

Figure 7:
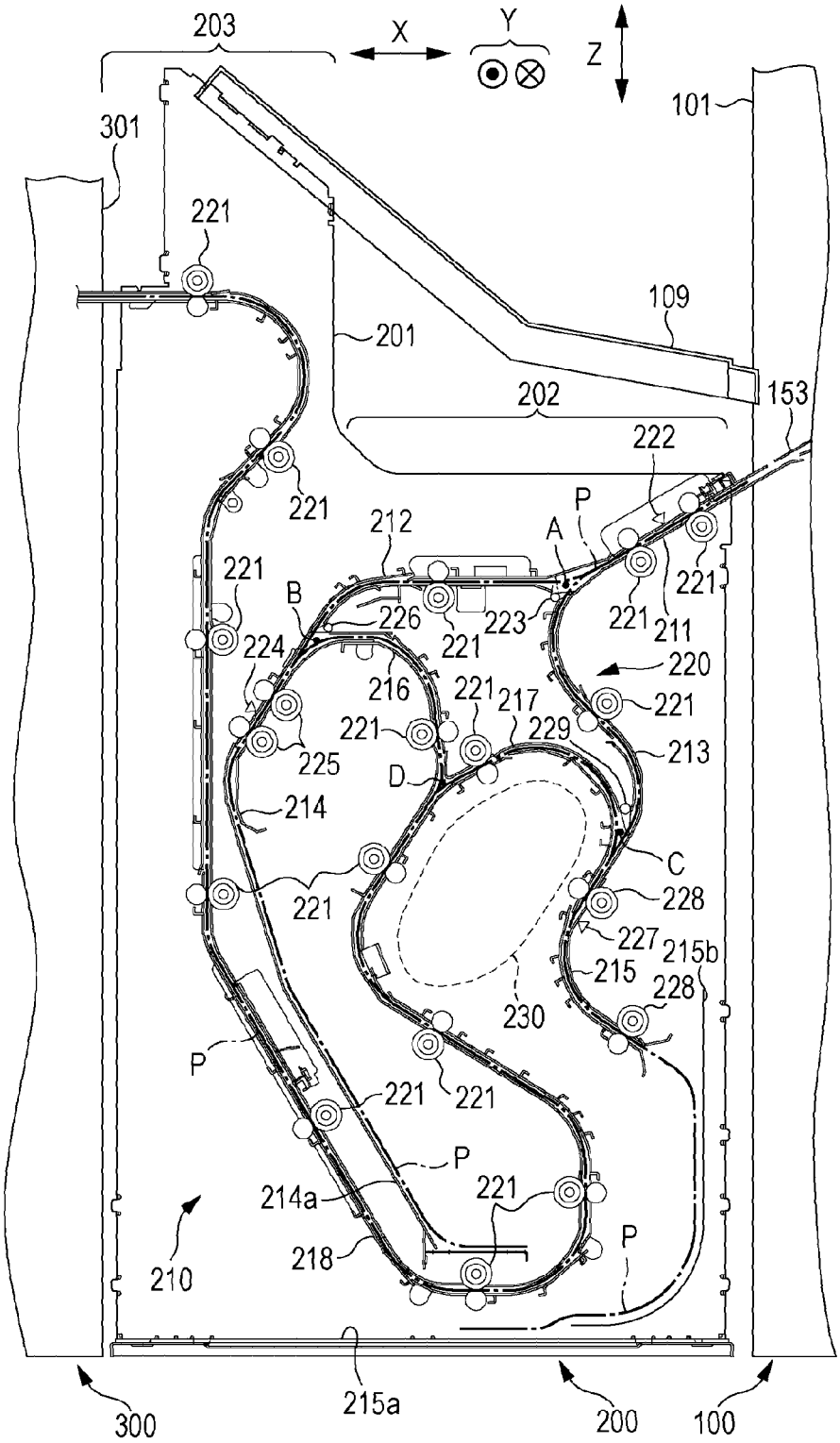
FIG. 7 is a schematic structure view of the transport apparatus.

As illustrated in FIG. 7, in the transport apparatus side housing 201 provided in the transport apparatus 200, an intermediate transport portion 220 which transports the paper sheet P along an intermediate transport path (intermediate path) 210 is provided. The intermediate transport path 210 is formed so that the paper sheet P is transported being curved by considering the direction which intersects the width direction of the medium and is a direction along the forward-and-rearward direction Y as the transport direction.

The intermediate transport portion 220 includes a plurality of intermediate transport rollers 221 provided along the intermediate transport path 210. In other words, as the intermediate transport rollers 221 are driven to be rotated in a state of nipping and supporting the paper sheet P from the both front and rear sides, the paper sheet P is transported along the intermediate transport path 210.

The intermediate transport path 210 includes the lead-in path 211 which is connected to the downstream end of the third discharge path 153 provided in the printer 100, and leads the paper sheet P into the transport apparatus side housing 201, at the upstream end thereof. The lead-in path 211 is provided at the upper position in the vertical direction Z in the lead-in portion 202, and straightly extends in a diagonally downward orientation which intersects the vertical direction Z toward the inside of the transport apparatus side housing 201 which is the downstream side from the inside of the recording apparatus side housing 101 which is the upstream side in the transport direction. In other words, the lead-in path 211 is provided to penetrate a part of a side wall which configures the left side surface of the recording apparatus side housing 101, and a part of a side wall which configures the right side surface of the transport apparatus side housing 201. In addition, in the downstream portion which is positioned in the transport apparatus side housing 201 in the lead-in path 211, a sensor 222 which detects the paper sheet P transported through the lead-in path 211 is provided.

An upstream end of a first branch path 212 and an upstream end of the second branch path 213 are respectively connected to the downstream end of the lead-in path 211 which extends diagonally downward. The first branch path 212 branches upward (leftward in FIG. 7) from the downstream end of the lead-in path 211, and extends to be curved downward in the middle of the path. The second branch path 213 branches being curved further downward (rightward in FIG. 7) from the downstream end of the lead-in path 211, and then, extends downward to meander. In other words, the intermediate transport path 210 branches to the first branch path 212 and the second branch path 213 from a branch point A which is the downstream end of the lead-in path 211. In addition, the paper sheet P transported through the lead-in path 211 is guided to any of the first branch path 212 and the second branch path 213 by the operation of a guide flap (guiding portion) 223 provided at the branch point A. In addition, the guide flap 223 is driven based on a signal which is sent when the sensor 222 detects the paper sheet P, and the position at which the paper sheet P transported through the lead-in path 211 is guided to the first branch path 212 and the position at which the paper sheet P is guided to the second branch path 213 are switched to each other.

As illustrated in FIG. 7, an upstream end of a first switchback path 214 is connected to the downstream end of the first branch path 212. The first switchback path 214 extends downward to be close to a bottom surface 215*a* of the transport apparatus side housing 201 in the vertical direction Z after being slightly curved rightward in the leftward-and-rightward direction X in the middle of the path. In other words, the downstream end of the first switchback path 214 is positioned at the lowermost part in the first switchback path 214. In addition, the length of the first switchback path 214 in the transport direction is configured to be longer than the medium length of the paper sheet P on which the recording can be performed by the printer 100 in the transport direction.

In the first switchback path 214, the downstream portion which further on the downstream side than the curved location is configured of a guide 214*a* which supports the paper sheet P transported being slightly curved rightward in the leftward-and-rightward direction X, from the lower side in the vertical direction Z. In addition, in the first switchback path 214, in the upstream portion which is further on the upstream side than the curved location, one sensor 224 which detects the paper sheet P transported through the first switchback path 214, and two first reverse roller pairs 225 which can rotate in a normal rotation direction and in a reverse rotation direction, are provided. Two first reverse roller pairs 225 perform the normal rotation driving or the reverse rotation driving based on a signal which is sent when the sensor 224 detects the paper sheet P. In other words, the paper sheet P transported through the first switchback path 214 is transported (switched back) after the orientation in which the paper sheet P is transported is reversed by the first reverse roller pair 225.

In addition, while the movement of the paper sheet P to the first switchback path 214 from the first branch path 212 is allowed at the downstream end of the first branch path 212, a first regulation flap 226 which regulates the movement of the paper sheet P to the first branch path 212 from the first switchback path 214 is provided. The first regulation flap 226 is biased to block the downstream end of the first branch path 212 due to a biasing force by the biasing member which is not illustrated.

Meanwhile, as illustrated in FIG. 7, an upstream end of a second switchback path 215 is connected to the downstream end of the second branch path 213. The second switchback path 215 is provided to extend downward in the vertical direction Z after being curved rightward in the leftward-and-rightward direction X in the middle of the path. In the second switchback path 215, the downstream end of the upstream portion including the curved location is opened toward the right inner side surface of the transport apparatus side housing 201. At the position which opposes the downstream end, a guide portion 215*b* which extends being curved across the bottom surface 215*a* of the transport apparatus side housing 201 from the right inner side surface of the transport apparatus side housing 201 is provided. In other words, when the paper sheet P is transported through the second switchback path 215, the tip end of the paper sheet P protrudes from the opened downstream end, the protruded tip end of the paper sheet P is guided by the guide portion 215*b*, and the tip end of the paper sheet P is led to dive into the bottom surface 215*a* of the transport apparatus side housing 201 and the lower part of the downstream end of the first switchback path 214.

In other words, the second switchback path 215 includes the guide portion 215*b* and the bottom surface 215*a* of the transport apparatus side housing 201. In addition, the length of the second switchback path 215 in the transport direction is equal to or longer than the medium length of the paper sheet P on which the recording can be performed by the printer 100 in the transport direction, similar to the case of the first switchback path 214. It is needless to say that the downstream portion of the second switchback path 215 configured of the guide portion 215*b* and the bottom surface 215*a* of the transport apparatus side housing 201 may be configured similar to the upstream portion or may be configured only of the guide portion 215*b*.

In addition, in the upstream portion of the second switchback path 215, at the position which is further on the upstream side than the curved location, one sensor 227 which detects the paper sheet P transported through the second switchback path 215, and one second reverse roller pair 228 which can rotate in the normal rotation direction and in the reverse rotation direction, are provided. In addition, one more second reverse roller pair 228 is provided at a position which is further on the downstream side than the curved location in the upstream portion of the second switchback path 215. Two second reverse roller pairs 228 perform the normal rotation driving or the reverse rotation driving based on the signal which is sent from the sensor 227. In other words, the paper sheet P transported through the second switchback path 215 is transported (switched back) after the orientation in which the paper sheet P is transported is reversed by the second reverse roller pair 228.

In addition, while the movement of the paper sheet P to the second switchback path 215 from the second branch path 213 is allowed at the downstream end of the second branch path 213, a second regulation flap 229 which regulates the movement of the paper sheet P to the second branch path 213 from the second switchback path 215 is provided. The second regulation flap 229 is biased to block the downstream end of the second branch path 213 due to the biasing force by the biasing member which is not illustrated.

As illustrated in FIG. 7, an upstream end of a first joining path 216 is connected to the upstream end of the first switchback path 214. In other words, the first joining path 216 extends being curved rightward in the leftward-and-rightward direction X from a first connection point B at which the downstream end of the first branch path 212 and the upstream end of the first switchback path 214 are connected to each other. In addition, an upstream end of a second joining path 217 is connected to the upstream end of the second switchback path 215. In other words, the second joining path 217 extends being curved leftward in the leftward-and-rightward direction X from a second connection point C at which the downstream end of the second branch path 213 and the upstream end of the second switchback path 215 are connected to each other. In addition, the first joining path 216 and the second joining path 217 join with each other at a joining point D which is positioned between the first switchback path 214 and the second switchback path 215.

In other words, when the paper sheet P is transported from the first branch path 212 to the first switchback path 214, the first regulation flap 226 is displaced to open the downstream end of the first branch path 212 as the tip end of the paper sheet P comes into contact with the first regulation flap 226. Meanwhile, when the paper sheet P is reversely transported (switched back) from the first switchback path 214, the paper sheet P is regulated not to be transported to the first branch path 212 by the first regulation flap 226, and the paper sheet P is guided to the first joining path 216. In addition, when the paper sheet P is transported to the second switchback path 215 from the second branch path 213, the second regulation flap 229 is displaced to open the downstream end of the second branch path 213 as the tip end of the paper sheet P comes into contact with the second regulation flap 229. Meanwhile, when the paper sheet P is reversely transported (switched back) from the second switchback path 215, the paper sheet P is regulated not to be transported to the second branch path 213 by the second regulation flap 229, and the paper sheet P is guided to the second joining path 217.

In addition, an upstream end of a lead-out path 218 is connected to the joining point D at which the downstream end of the first joining path 216 and the downstream end of the second joining path 217 are connected to each other. The lead-out path 218 detours to go around the lower side of the downstream end of the first switchback path 214, and extends to an upper portion of the lead-out portion 203, after extending downward being curved to pass through between the first switchback path 214 and the second switchback path 215 toward the post-processing apparatus 300. The downstream end of the lead-out path 218 penetrates a part of the side wall on the left side in the transport apparatus side housing 201, and extends toward the post-processing apparatus 300. In other words, the intermediate transport path 210 includes the lead-in path 211, the first branch path 212, the second branch path 213, the first switchback path 214, the second switchback path 215, the first joining path 216, the second joining path 217, and the lead-out path 218. In addition, in the positional relationship of each of the points A, B, C, and D, the points are disposed in order of "A, B, D, C" from above in the vertical direction Z, and are disposed in order of "C, A, D, B" from right in the leftward-and-rightward direction X.

In addition, in the embodiment, the lengths of the first branch path 212 and the second branch path 213 in the transport direction are substantially the same as each other. In addition, the lengths of the first joining path 216 and the second joining path 217 are also substantially the same as each other.

Next, an operation when eliminating the transport failure of the paper sheet P in the printer 100 and in the recording system 1000 which includes the printer 100 and the transport apparatus 200, will be described.

Similar to the printer 100 illustrated in FIG. 3, the recording is performed on the sheet-like medium, such as the paper sheet P, and in the recording apparatus which transports the medium, there is a case where the transport failure, such as paper jamming, occurs while transporting the paper sheet P along the path. In particular, in the recording apparatus which performs the recording by dispensing the liquid, such as the ink, onto the medium, the recording surface of the paper sheet P expands, and curl which makes the recording surface be in a convex shape is likely to be generated. Therefore, the transport failure is likely to occur further on the downstream side than the recording portion 110. Here, in order to make it easy to take out the paper sheet P which is jammed while being transported, the printer 100 of the embodiment can pull out a part of the discharge path 150 and a part of the branch path 160 from the recording apparatus side housing 101.

Figure 8:
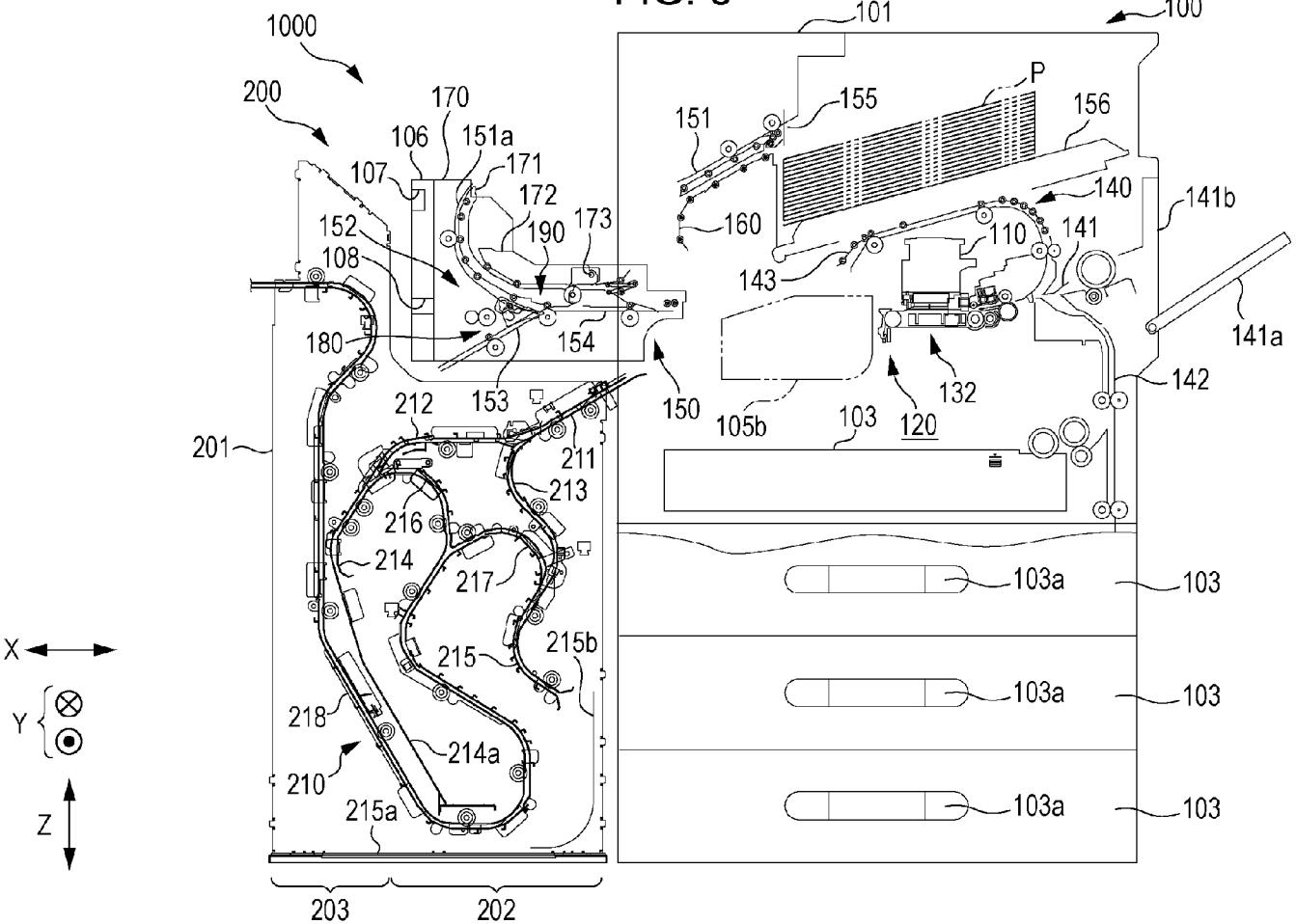
FIG. 8 is a schematic structure view illustrating a part of the recording system in a state where a pull-out unit is pulled out.

As illustrated in FIG. 8, when the paper jamming of the paper sheet P occurs in the discharge path 150 and the branch path 160, first, after removing the paper feeding tray 109 attached to the pull-out surface portion 106, the user hooks the hand to the handle portion 107 formed in the pull-out surface portion 106, and pulls out the pull-out surface portion 106 along the pulling-out direction which is the leftward direction in the leftward-and-rightward direction X that is the transport direction of the paper sheet P. When the pull-out surface portion 106 is pulled out along the pulling-out direction, the pull-out unit 170 is pulled out from the recording apparatus side housing 101 together with the pull-out surface portion 106. In other words, the curved reverse path 151*a*, the second discharge path 152, and the third discharge path 153, which configure the discharge path 150, and a part of the branch path 160, are pulled out. Furthermore, the guiding mechanism 180 provided at the branch position 190 which is the downstream end of the common discharge path 154 is also pulled out to the outside of the recording apparatus side housing 101.

At this time, since the height of the lead-in portion 202 which configures the transport apparatus 200 attached to the left side of the printer 100 is formed to be lower than the lower portion of the pull-out surface portion 106, the lead-in portion 202 does not interfere with the pull-out surface portion 106 and the pull-out unit 170 when the pull-out unit 170 is pulled out. In addition, the length of the lead-in portion 202 in the leftward-and-rightward direction X is formed to be longer than the length by which the pull-out unit 170 is pulled out from a region (moving region) in which the pull-out unit 170 moves in the leftward-and-rightward direction X, that is, the pull-out unit 170 is pulled out from the recording apparatus side housing 101. Therefore, the lead-out portion 203 formed to be higher than the lead-in portion 202 does not interfere with the pull-out surface portion 106 and the pull-out unit 170 when the pull-out unit 170 is pulled out. In other words, the transport apparatus 200 is formed to avoid the moving region when the pull-out unit 170 is pulled out from the recording apparatus side housing 101. In addition, if the pull-out unit 170 can be pulled out in the direction which intersects the transport direction of the paper sheet P, when pulling out the pull-out unit 170, there is a concern that the jammed paper sheet P is torn off in the path. Therefore, it is preferable that the pull-out unit 170 can be pulled out in the direction along the transport direction of the paper sheet P.

Figure 9:
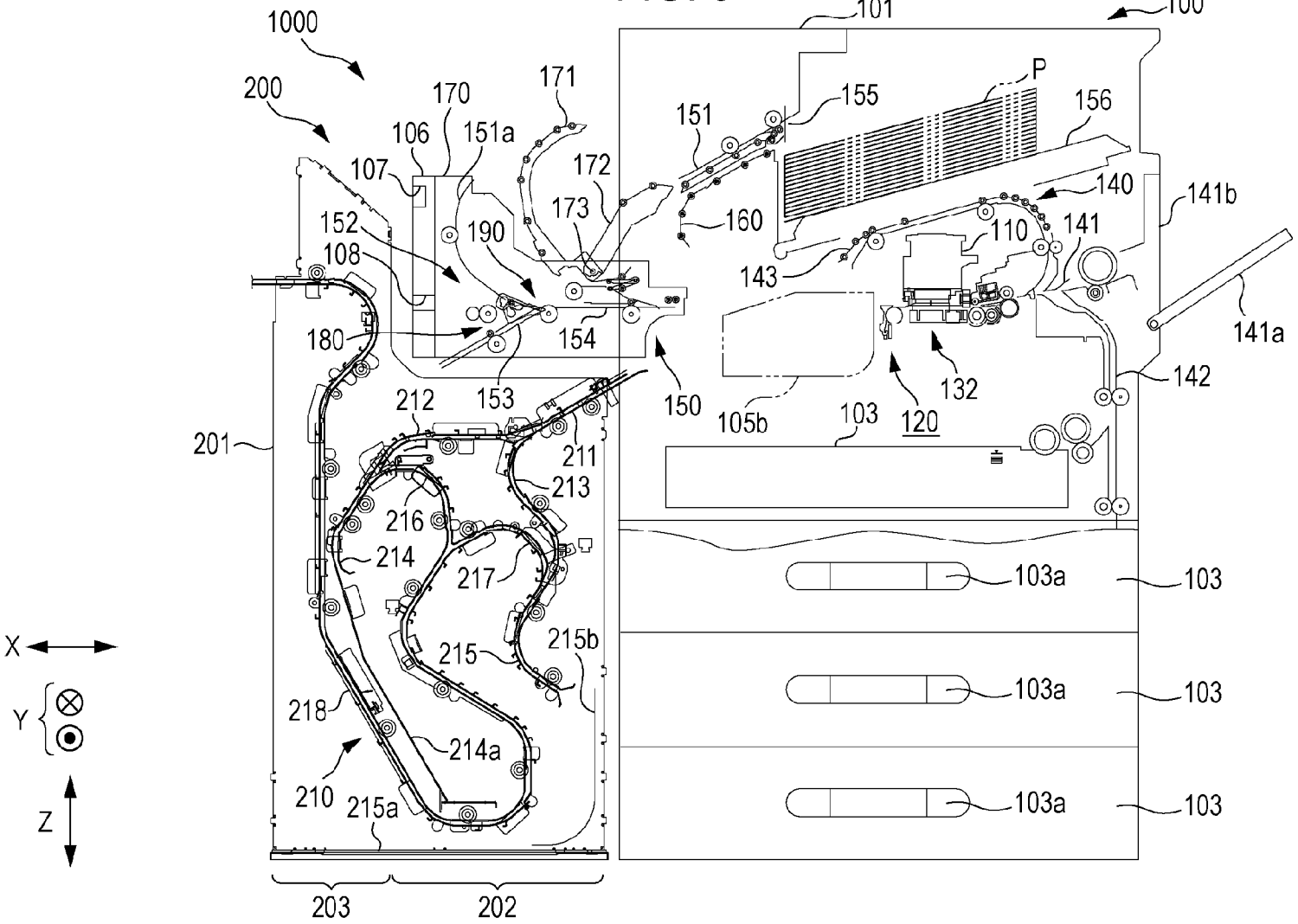
FIG. 9 is a schematic structure view illustrating a part of the recording system when a path forming portion rotates in a state where the pull-out unit is pulled out.

As illustrated in FIG. 9, after pulling out the pull-out unit 170 from the recording apparatus side housing 101, the first path forming portion 171 and the second path forming portion 172 which are attached to the pull-out unit 170 are rotated in the clockwise direction around the axis 173. Then, the guide surface on the inner side of the curved reverse path 151*a* which configures the first discharge path 151 is separated from the guide surface on the outer side, and the guide surface on the outer side of the branch path 160 is separated from the guide surface on the inner side. As the guide surfaces on the outer sides and the guide surfaces on the inner sides of the curved reverse path 151*a* and the branch path 160 are respectively separated from each other, the inside of the path is opened, and the paper sheet P jammed in the path can be taken out. In addition, when pulling out the pull-out unit 170, there is a case where the paper sheet P remains not in the pull-out unit 170, but in the recording apparatus side housing 101. In this case, the paper sheet P is pulled off by inserting the hand from the opening portion 105*b* formed above the paper cassette 103, and the transport failure is eliminated. In addition, the opening portion 105*b* formed in the frame 105 of the printer 100 is formed at a position of which at least a part overlaps the pull-out unit 170 when viewed from the forward-and-rearward direction Y, in a state where the pull-out unit 170 is not pulled out from the recording apparatus side housing 101.

Next, an operation when the printer 100 performs the recording on the paper sheet P will be described.

As illustrated in FIG. 3, in the printer 100, when performing the recording on the paper sheet P, the recording is performed on any of the paper sheet P accommodated in the paper cassette 103 and the paper sheet P inserted from the insertion port 141*b*. At this time, when performing the recording on the medium which cannot be accommodated in the paper cassette 103, particularly the medium having a large amount of rigidity, such as a thick paper sheet, the thick paper sheet is inserted from the insertion port 141*b*, and is transported to the recording portion 110 through the first supply path 141. Since the medium, such as the thick paper sheet, is unlikely to be curved due to a large amount of rigidity, there is a case where the transport failure, such as paper jamming, occurs when being transported through the transport path 120 having a high degree of curve. Therefore, the first supply path 141 is a linear path which has a smaller degree of curve compared to that of the second supply path 142, and straightly extends toward the recording portion 110.

The thick paper sheet on which the recording is performed by the recording portion 110 is transported to any of the first discharge path 151, the second discharge path 152, and the third discharge path 153 which configure the discharge path 150. Here, when loading the thick paper sheet on which the recording has been completed on the loading table 156, the thick paper sheet is transported through the first discharge path 151. However, since the first discharge path 151 includes the curved reverse path 151*a* which is largely curved, when the thick paper sheet is transported, there is a concern that the transport failure occurs. In addition, when the thick paper sheet is loaded on the stacker 302 provided in the post-processing apparatus 300 via the transport apparatus 200 from the third discharge path 153, since it becomes necessary to provide a path which has a small degree of curve in the transport apparatus 200, there is a concern that the degree of freedom of design of the intermediate transport path 210 provided in the transport apparatus 200 deteriorates.

Here, the printer 100 of the embodiment is provided with the second discharge path 152 which is formed to straightly extend along the common discharge path 154. In other words, the thick paper sheet which passes through the recording portion 110 from the second supply path 142 and is transported through the common discharge path 154 and the second discharge path 152, is transported in a state where one surface which is the upper side in the vertical direction Z is oriented to the upper side all the time when being inserted into the insertion port 141*b*. In addition, while maintaining the state where the one surface which is the recording surface is oriented to the upper side, the thick paper sheet is discharged from the discharge port 108 and is loaded on the paper feeding tray 109.

Next, an operation when the transport apparatus 200 transports the paper sheet P will be described.

As illustrated in FIG. 3, in a case where the post-processing is performed with respect to the paper sheet P on which the recording is performed by the recording portion 110 provided in the printer 100, the paper sheet P is transported to the post-processing apparatus 300 via the transport apparatus 200. In other words, the paper sheet P on which the recording has been completed is guided to the third discharge path 153 from the common discharge path 154 by the branch mechanism 147, and is led into the lead-in path 211 in the recording apparatus side housing 101.

Figure 10A:
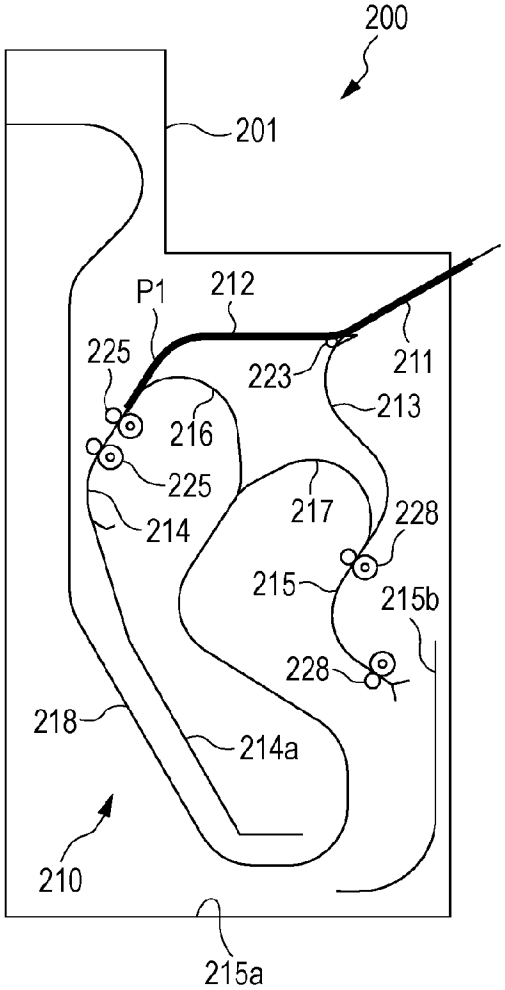
FIGS. 10A to 10C are views illustrating a state when transporting the medium in the transport apparatus.

As illustrated in FIG. 10A, a first paper sheet P1 which is led into the transport apparatus side housing 201 is transported to the downstream side along the lead-in path 211. In addition, as the guide flap 223 provided at the downstream end of the lead-in path 211 is positioned to block the upstream end of the second branch path 213, the paper sheet P1 is guided to the first branch path 212. Next, when the paper sheet P1 passes through the lead-in path 211, a second paper sheet P2 is led into the lead-in path 211.

Figure 10B:
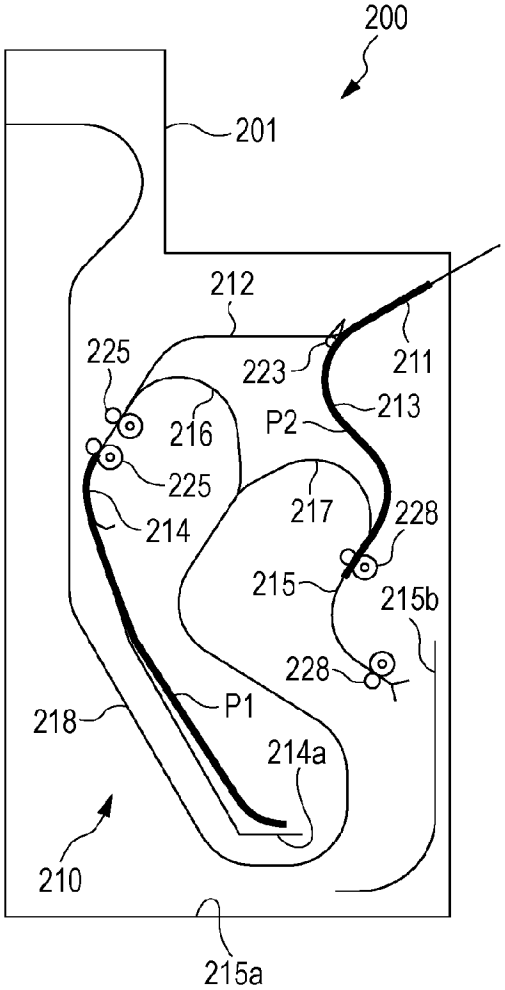

As illustrated in FIG. 10B, the paper sheet P1 transported through the first branch path 212 is transported to the first switchback path 214 by the first reverse roller pair 225 which is driven to be normally rotated. Meanwhile, as the guide flap 223 is positioned to block the upstream end of the first branch path 212, the paper sheet P2 transported through the lead-in path 211 is guided to the second branch path 213. The paper sheet P2 transported to the second branch path 213 is transported to the second switchback path 215 by the second reverse roller pair 228 which is driven to be normally rotated. Next, when the paper sheet P2 passes through the lead-in path 211, a third paper sheet P3 is led into the lead-in path 211.

Figure 10C:
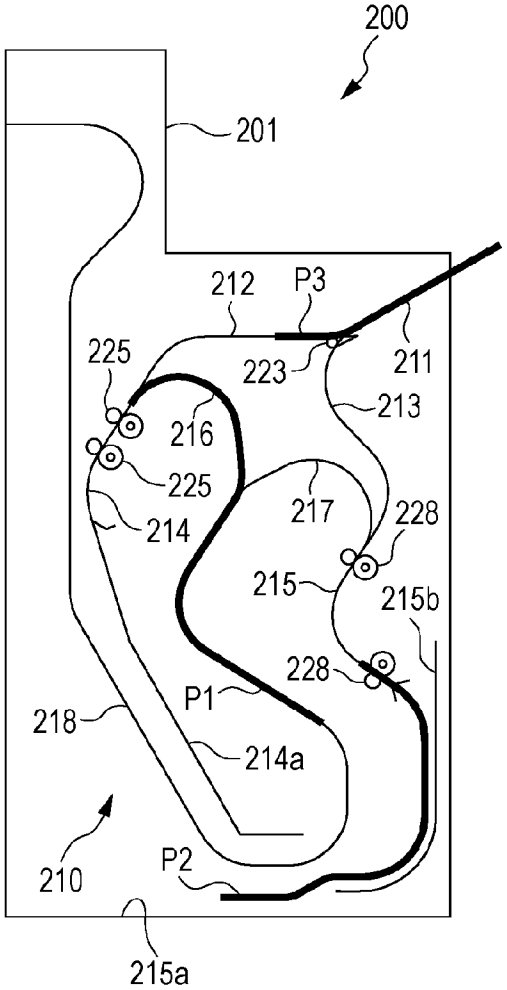

As illustrated in FIG. 10C, the paper sheet P1 which is transported to the downstream side through the first switchback path 214, and is stored in the first switchback path 214, is transported toward the upstream side from the downstream side of the first switchback path 214 by the first reverse roller pair 225 which is driven to be reversely rotated, and is transported to the lead-out path 218 through the first joining path 216. Meanwhile, the tip end of the paper sheet P2 transported through the second switchback path 215 protrudes from the opened downstream end of the second switchback path 215, and is led to the bottom surface 215*a* of the transport apparatus side housing 201 along the guide portion 215*b*. In addition, there is also a case where the paper sheet P2 is not led to the bottom surface 215*a* of the transport apparatus side housing 201 due to the medium length of the paper sheet P transported through the second switchback path 215 in the transport direction. In addition, the paper sheet P3 transported through the lead-in path 211 is guided to the first branch path 212 by the guide flap 223. Next, when the paper sheet P3 passes through the lead-in path 211, a fourth paper sheet P4 is led into the lead-in path 211.

Figure 11B:
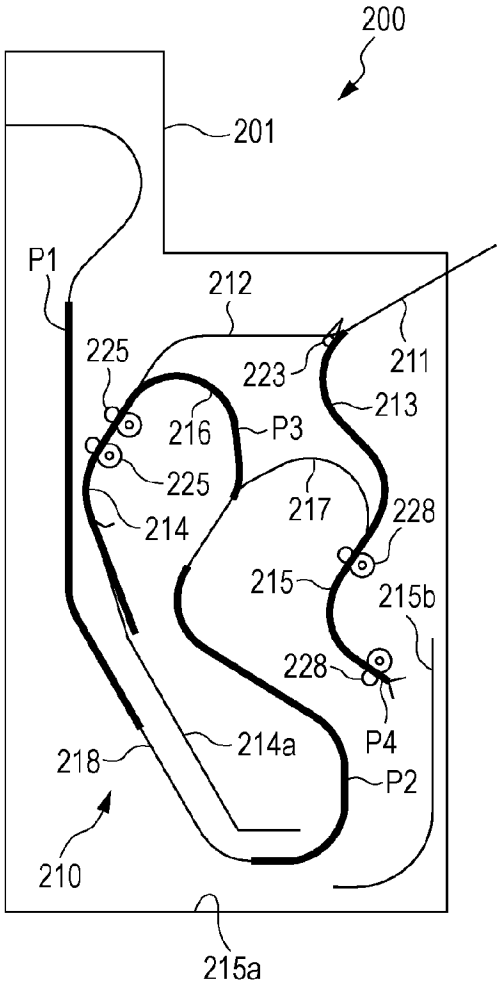
FIGS. 11A and 11B are views illustrating a state when transporting the medium in the transport apparatus.
Figure 11A:
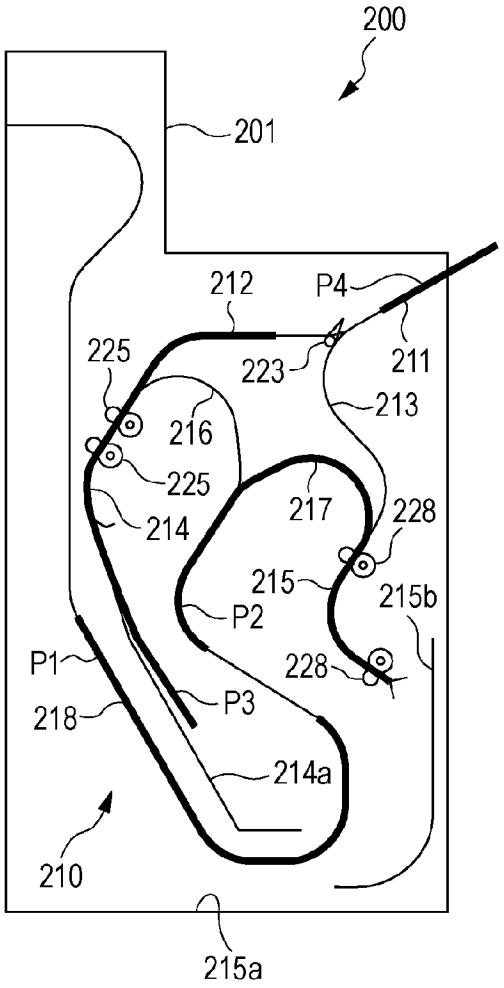

As illustrated in FIG. 11A, the paper sheet P2 stored in the second switchback path 215 is transported toward the upstream side from the downstream side of the second switchback path 215 by the second reverse roller pair 228 which is driven to be reversely rotated, and is transported to the lead-out path 218 through the second joining path 217. Meanwhile, the paper sheet P3 transported through the first branch path 212 is transported to the first switchback path 214.

As illustrated in FIG. 11B, the paper sheet P3 transported through the first switchback path 214 is transported to the lead-out path 218 through the first joining path 216 by the first reverse roller pair 225. Meanwhile, the paper sheet P4 transported through the lead-in path 211 is guided to the second branch path 213 by the guide flap 223, and is transported to the second switchback path 215.

In other words, each of the paper sheets P1, P2, P3, and P4 which are transported through the lead-in path 211 one after another, is alternately guided to the first branch path 212 and the second branch path 213 by the guide flap 223. For example, in a case where the first paper sheet P1 is guided to the second branch path 213, the second paper sheet P2 is transported to the first branch path 212.

In this manner, the posture of the paper sheet P on which the recording is performed by the printer 100 is reversed by the transport apparatus 200, and the paper sheet P is transported to the post-processing apparatus 300 in a state where the recording surface is oriented to the lower side in the vertical direction Z when the simplex printing is performed. In addition, at this time, since it is not preferable that the paper sheet P is transported to the post-processing apparatus 300 in a state where the curl is generated in the paper sheet P, the length of the intermediate transport path 210 in the transport apparatus side housing 201 is ensured in the transport direction of the paper sheet P by making the path be curved and extend to meander.

In other words, it is known that the curl of the paper sheet P generated as the ink adheres to the recording head 111 provided in the recording portion 110, is gradually settled as time elapses. Therefore, by ensuring the length of the intermediate transport path 210, the transport apparatus 200 ensures time which is required until the degree of the curl generated in the paper sheet P becomes equal to or less than a predetermined degree, as time which is required for transporting the paper sheet P through the intermediate transport path 210. After this, the post-processing apparatus 300 performs the post-processing, such as cutting or stapling, with respect to the paper sheet P.

In particular, since the printing is performed at a high speed onto the paper sheet P by the line head type recording head 111, and the transporting is performed at a high speed, there is a possibility that the paper sheet P is transported without being sufficiently dried. In other words, there is a concern that the paper sheet P is transported to the post-processing apparatus 300 in a state where the curl is not sufficiently settled, and the post-processing cannot be correctly performed. However, when the transport speed is decreased in the intermediate transport path 210 for ensuring the drying time, the entire throughput decreases since the paper sheet transported at a high speed when the recording is performed is separated from the paper sheet which previously transported through the intermediate transport path 210 not to collide with the previous paper sheet. In particular, there is a possibility that the following paper sheet collides with the previous paper sheet in the middle of the post-processing with respect to the previous paper sheet.

Here, in the transport apparatus 200, as the plurality of switchback paths, such as the above-described first switchback path 214 and the second switchback path 215 are provided, it is possible to ensure the length of the intermediate transport path 210 and provide the drying time while suppressing an increase in the size of the inside of the transport apparatus 200. In addition, it is possible to perform the recording on the paper sheet without both unnecessary increase in the distance between the paper sheets, and deterioration of the throughput. In addition, as described above, by using the shape of the path which is curved and extend to meander as the intermediate transport path 210, it is possible to further gain the drying time.

According to the above-described embodiment, the following effects can be achieved.

(1) The moving region when the pull-out unit 170 provided in the printer 100 is pulled out is configured to avoid the transport apparatus 200 and the post-processing apparatus 300 which configure the recording system 1000. Therefore, when eliminating the transport failure of the paper sheet P in the printer 100, it is possible to easily remove the medium.

(2) When the transport failure of the paper sheet P occurs in the discharge path 150 and the branch path 160, by pulling out the pull-out unit 170 from the recording apparatus side housing 101, the transport failure of the paper sheet P remaining in the path is eliminated, but there is a case where the paper sheet P remains in the recording apparatus side housing 101 when pulling out the paper sheet P. Even in this case, as the user inserts the hand from the opening portion 105*b* formed in the recording apparatus side housing 101, it is possible to easily take out the paper sheet P from the inside of the recording apparatus side housing 101.

(3) The first path forming portion 171 which configures a part of the curved reverse path 151*a* and the second path forming portion 172 which configures a part of the branch path 160, are provided to be rotatable around the axis 173 in the pull-out unit 170. Therefore, it is possible to easily eliminate the transport failure of the paper sheet P in the curved reverse path 151*a* and the branch path 160.

(4) Since the pull-out unit 170 is configured to be capable of being pulled out to the position at which the axis 173 that is the rotation fulcrum of the first path forming portion 171 is exposed from the recording apparatus side housing 101, when the first path forming portion 171 is rotated, it is possible to suppress a concern that the tip end of the first path forming portion 171 interferes with the recording apparatus side housing 101.

(5) The pull-out unit 170 which is pulled out from the recording apparatus side housing 101 is configured to be capable of being pulled out from the recording apparatus side housing 101 together with the guiding mechanism 180 provided in the branch position 190 in which the transport failure of the paper sheet P is likely to be generated. Therefore, it is possible to easily remove the paper sheet P when eliminating the transport failure of the paper sheet P in the printer 100.

(6) In a case where the recording is performed on the paper sheet P which has a large amount of rigidity and does not require the post-processing, such as a thick paper sheet, in the printer 100, the second discharge path 152 which serves as the non-reverse discharge path through which the paper sheet P is transported without reversing the posture of the paper sheet P in the vertical direction Z, is provided. In other words, since it is not necessary to transport the thick paper sheet toward the post-processing apparatus 300 via the third discharge path 153 which serves as the lower discharge path, it does not waste time when transporting the paper sheet P. Therefore, even in a case where the post-processing apparatus 300 which performs the post-processing with respect to the paper sheet P is attached to the printer 100, it is possible to shorten the transport time with respect to the paper sheet P that has a large amount of rigidity and does not require the post-processing.

(7) Since the second discharge path 152 linearly extends along the direction in which the common discharge path 154 extends, it is possible to reduce a concern that the transport failure occurs even in a case where the medium having a large amount of rigidity, such as the thick paper sheet, is transported.

(8) Since the second discharge path 152 is provided to extend to the upper part of the third discharge path 153 in the vertical direction Z, it is possible to provide an external apparatus, such as the transport apparatus 200 or the post-processing apparatus 300, below the paper feeding tray 109 which discharges the paper sheet P transported through the second discharge path 152. Therefore, in a case where the external apparatus is attached to the printer 100, when viewed from the upper side in the vertical direction Z, it is possible to suppress an increase in the installation area of the entire apparatus.

(9) By pulling out the pull-out unit 170 which is attached to a part of the first discharge path 151 and a part of the branch path 160 from the recording apparatus side housing 101, it is possible to easily take out the paper sheet P in the path. Therefore, it is possible to eliminate the transport failure of the paper sheet P which occurs in the first discharge path 151 and the branch path 160.

(10) Since the paper feeding tray 109 has a rising shape which is inclined to ascend forward, which rises to the upper side in the vertical direction Z when approaching the downstream side in the transport direction, it is possible to reduce a concern that all of the loaded paper sheets P are pushed out to the paper sheet P which is to be discharged later and fall.

(11) As the transport apparatus 200 provided with the intermediate transport path 210 is provided between the printer 100 and the post-processing apparatus 300, it is possible to gain the transport time during which the paper sheet P that requires the post-processing is transported. In other words, by gaining the transport time of the paper sheet P, it is possible to suppress the degree of the curl generated in the paper sheet P due to the recording by the recording portion 110.

(12) Since the first switchback path 214 and the second switchback path 215 have a shape of a path which is curved and extends to meander, it is possible to settle the paths in a relatively small space, and to contribute to reducing the size of the transport apparatus side housing 201, while ensuring the lengths of each of the switchback paths 214 and 215.

(13) When viewed from the forward-and-rearward direction Y, the paper feeding tray 109 has a part which overlaps the intermediate transport path 210 in the vertical direction, and is disposed to avoid the highest part of the intermediate transport path 210 in the vertical direction Z by the rising shape. Therefore, while ensuring the rising shape of the paper feeding tray 109, it is possible to transport the paper sheet P to the post-processing apparatus 300 at the high position. By delivering the paper sheet P at the high position with respect to the post-processing apparatus 300, it is possible to ensure the loading amount of the stacker 302 or the length of the lead-out path 218.

(14) In order to improve the processing speed of the paper sheet P which is led in from the lead-in path 211, the transport apparatus 200 includes two switchback paths which switch back the paper sheet P, that is, the first switchback path 214 and the second switchback path 215. Here, when considering that the post-processing apparatus 300 which performs the post-processing with respect to the paper sheet P is attached to the transport apparatus 200, it is preferable that the paper sheet P is led out to the post-processing apparatus 300 at the high position in the vertical direction Z. Therefore, since the lead-out path 218 is configured to extend in order to detour the downstream end of the first switchback path 214, there is a concern that the dimension of the transport apparatus 200 increases in the vertical direction Z.

Here, the first connection point B at which the downstream end of the first branch path 212 and the upstream end of the first switchback path 214 are connected to each other, is provided to be further on the upper side than the second connection point C at which the downstream end of the second branch path 213 and the upstream end of the second switchback path 215 are connected to each other, in the vertical direction Z. In other words, since the downstream end of the first switchback path 214 is pulled up in the vertical direction Z, it is possible to suppress the height dimension of the transport apparatus 200 in the vertical direction Z even in a configuration in which the lead-out path 218 extends to detour the downstream end of the first switchback path 214. Therefore, it is possible to suppress an increase in the size of the apparatus while improving the processing speed of the paper sheet P.

(15) Since the first connection point B to which the upstream end of the first switchback path 214 is connected is positioned below the branch point A which branches to the first branch path 212 and the second branch path 213 from the downstream end of the lead-in path 211 in the vertical direction Z, it is possible to reduce a concern that the size of the transport apparatus 200 increases since the first connection point B is positioned above the branch point A.

(16) Since the lead-in path 211 is provided to extend in the diagonally downward orientation which intersects the vertical direction Z, as illustrated in FIG. 7, it is possible to make the lead-in path 211 relatively easily branch to the first branch path 212 that branches leftward and to the second branch path 213 that branches downward, from the downstream end of the lead-in path 211.

(17) Since the lead-in path 211 is provided on the upper side in the vertical direction Z in the transport apparatus side housing 201, when the first switchback path 214 and the second switchback path 215 which extend downward in the vertical direction Z are provided, it is possible to form the short lead-in path 211. Therefore, it is possible to improve the degree of freedom of the path shape of the intermediate transport path 210 in the transport apparatus side housing 201.

(18) Since the part which is the downstream side of the second switchback path 215 is configured of the guide portion 215*b* and the bottom surface 215*a* of the transport apparatus side housing 201, it is possible to reduce costs required for manufacturing.

(19) Since the part which is the downstream side of the second switchback path 215 is configured to include the bottom surface 215*a* of the transport apparatus side housing 201, compared to a configuration in which the second switchback path 215 extends downward in the vertical direction Z similar to the first switchback path 214, it is possible to reduce a concern that the size of the transport apparatus 200 increases.

(20) The length of the intermediate transport path 210 is ensured as the entire path is curved to meander. By ensuring the length of the path, the curl generated in the paper sheet P is settled to be equal to or less than the predetermined degree in the middle of transporting through the intermediate transport path 210, and the paper sheet P can be led out to the post-processing apparatus 300 in a state where the curl is settled. Therefore, the transport apparatus 200 can discharge the paper sheet P in a state where the degree of the curl generated in the paper sheet is suppressed.

(21) In the transport apparatus 200, in a case where the processing is continuously performed with respect to the plurality of paper sheets P, since two switchback paths, that is, the first switchback path 214 and the second switchback path 215, are provided, it is not necessary for the second paper sheet P2 which is led into the transport apparatus 200 to standby until the previous first paper sheet P1 is led out. Therefore, since it is possible to lead out the paper sheets P2, P3, and P4 one after another following the paper sheet P1, it is possible to improve the processing speed of the paper sheet P.

In addition, the above-described embodiment may be changed as follows.

Figure 12:
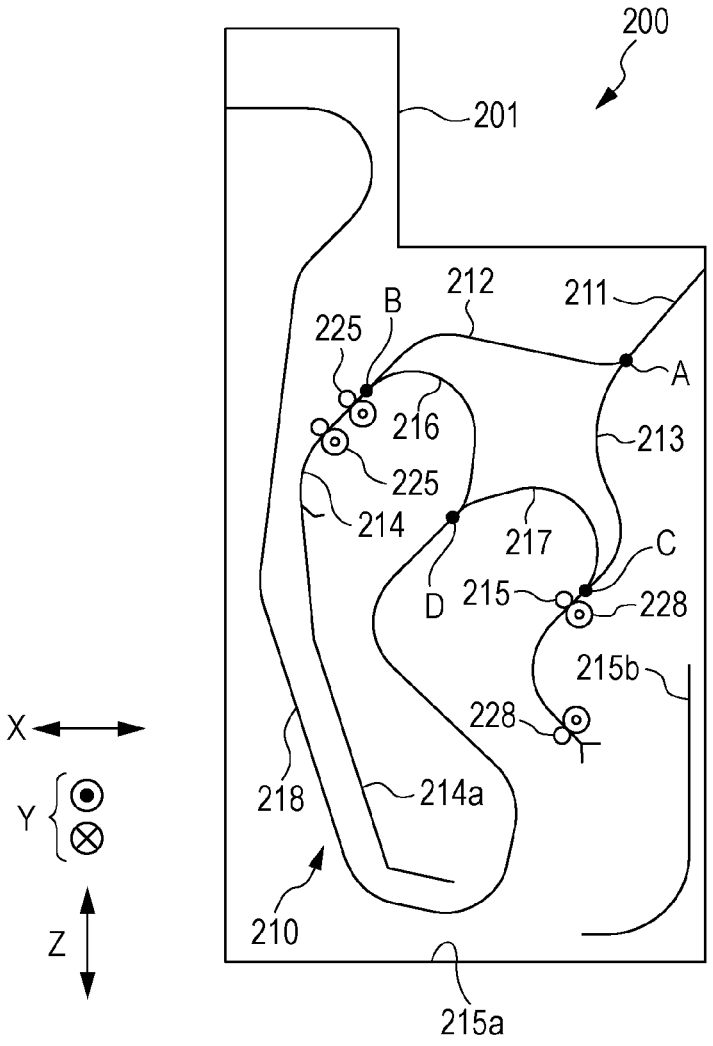
FIG. 12 is a view illustrating a modification example of the transport apparatus.

In the above-described embodiment, as illustrated in FIG. 12, the second connection point C at which the downstream end of the second branch path 213 and the upstream end of the second switchback path 215 are connected to each other, may be configured to be disposed further on the left side than the branch point A which branches to the first branch path 212 and the second branch path 213 from the downstream end of the lead-in path 211, in the leftward-and-rightward direction X. In this configuration, compared to the embodiment illustrated in FIG. 7, it is possible to reduce the dimension of the intermediate transport path 210 in the leftward-and-rightward direction X and in the vertical direction Z while ensuring the length of the intermediate transport path 210.

Figure 13:
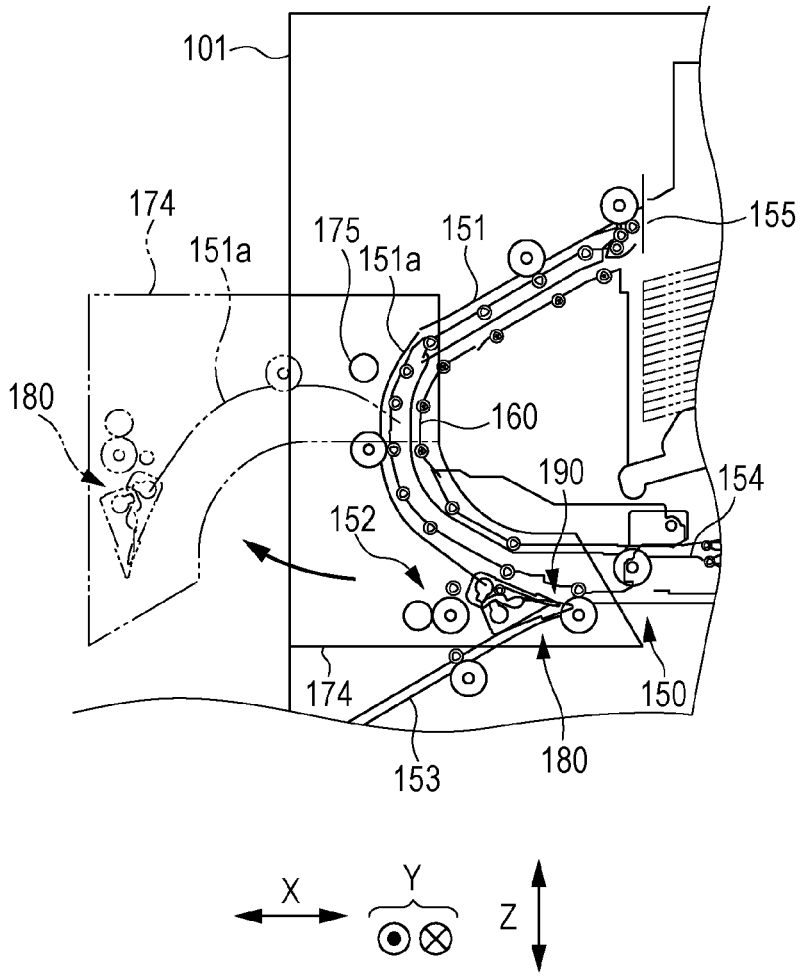
FIG. 13 is a view illustrating a rotation unit as a modification example of the pull-out unit.

In the above-described embodiment, as illustrated in FIG. 13, the pull-out unit 170 provided in the printer 100 may be configured as a rotation unit 174 which is provided to be rotatable with respect to the recording apparatus side housing 101. In this configuration, as the rotation unit 174 rotates around a rotation axis 175 provided in the recording apparatus side housing 101, a part of the discharge path 150 is exposed. At this time, since the rotation unit 174 configures the guide surface of the guide on the outer side of the curved reverse path 151*a* provided in the first discharge path 151, the inside of the curved reverse path 151*a* is opened. In addition, since the guiding mechanism 180 is also attached to the rotation unit 174, the guiding mechanism 180 is rotated with respect to the recording apparatus side housing 101 together with the rotation unit 174. In other words, as the guiding mechanism 180 moves to the outside of the recording apparatus side housing 101 together with the rotation unit 174, the branch position 190 which is the position at which the transport failure of the paper sheet P is likely to occur, is exposed when viewed from the left direction in the leftward-and-rightward direction X. Therefore, it is possible to easily remove the medium when the transport failure of the medium is eliminated in the recording apparatus. In addition, a member in which there is a concern that the rotation unit 174 is interfered during the rotation, is configured not to interfere with the rotation unit 174 by making the shape thereof have a shape of comb teeth.

In the above-described embodiment, at the location illustrated by a dotted line of FIG. 7, an opening portion 230 through which the user can insert the hand may be formed. In this configuration, when the transport failure, such as paper jamming, occurs in the transport apparatus 200, it is possible to eliminate the transport failure by opening an opening/closing cover which configures the external appearance of the transport apparatus 200, by inserting the hand from the opening portion 230 provided on the side wall which forms the intermediate transport path 210, and by pulling out the jammed paper sheet P.

The above-described embodiment is not limited to the configuration in which the transport apparatus 200 avoids the moving region of the pull-out unit 170 as the size of the lead-in portion 202 is formed to be lower than the lower portion of the pull-out surface portion 106 in the vertical direction Z. For example, the transport apparatus 200 may be configured to be attached to a position higher than the upper portion of the pull-out surface portion 106.

In the above-described embodiment, the recording system 1000 may have a configuration in which the intermediate transport path 210 provided in the transport apparatus 200 is provided in the recording apparatus side housing 101 provided in the printer 100. In other words, a configuration in which the printer 100 and the transport apparatus 200 are integrated may be employed.

The above-described embodiment is not limited to the configuration in which the lead-out portion 203 which configures the transport apparatus 200 is formed to be higher than the lead-in portion 202 in the vertical direction Z. For example, a configuration in which the height is substantially the same as that of the lead-in portion 202, or is lower than that of the lead-in portion 202, may be employed.

The above-described embodiment is not limited to the configuration in which the pull-out unit 170 is indirectly pulled out by pulling out the pull-out surface portion 106. For example, a configuration in which a slide type door or an opening/closing type cover is provided instead of the pull-out surface portion 106, and the pull-out unit 170 is pulled out by directly hooking the hand to the pull-out unit 170, may be employed.

The above-described embodiment is not limited to the configuration in which the pull-out unit 170 is manually pulled out by hooking the hand to the handle portion 107. For example, a configuration in which the pull-out unit 170 is automatically pulled out via the operation portion 102, may be employed.

In the above-described embodiment, the post-processing apparatus 300 may be configured to load the paper sheet P on the stacker 302 as it is without performing the post-processing in the post-processing apparatus side housing 301 with respect to the paper sheet P transported from the transport apparatus 200.

The above-described embodiment is not limited to the configuration in which the guiding mechanism 180 is controlled by the control portion which is provided in the printer 100 and is not illustrated. For example, a configuration in which a lever which operates the guiding mechanism 180 is provided in the recording apparatus side housing 101, and the upper position and the lower position of the first guiding portion 181 and the second guiding portion 182 that configure the guiding mechanism 180, are manually switched, may be employed.

The above-described embodiment is not limited to the configuration in which the first discharge path 151, the second discharge path 152, and the third discharge path 153 branch from one branch position 190. For example, a configuration in which the path branches to the third discharge path 153 in the middle of the common discharge path 154, and the path branches to the first discharge path 151 and the second discharge path 152 at the downstream end of the common discharge path 154, may be employed. In addition, a configuration in which the path branches to the first discharge path 151 in the middle of the common discharge path 154, and the path branches to the second discharge path 152 and the third discharge path 153 at the downstream end of the common discharge path 154, may be employed.

The above-described embodiment is not limited to the configuration in which the second discharge path 152 more straightly extends along the common discharge path 154. For example, a configuration of extending being inclined slightly upward in the vertical direction Z, a configuration of extending being inclined downward, or a configuration of extending being slightly curved, may be employed.

The above-described embodiment is not limited to the configuration in which the lead-in path 211 penetrates the side surface of the transport apparatus side housing 201 and extends. For example, a configuration in which the lead-in path 211 penetrates the upper surface and extends, may be employed.

The above-described embodiment is not limited to the configuration in which the lead-in path 211 is provided on the upper side in the vertical direction Z in the transport apparatus side housing 201. For example, a configuration in which the lead-in path 211 is provided on the lower side, may be provided.

In the above-described embodiment, similar to the first switchback path 214, the downstream portion of the second switchback path 215 that is configured of the guide portion 215*b* and the bottom surface 215*a* of the transport apparatus side housing 201 may be configured of the guide which supports the paper sheet P from one surface.

In the above-described embodiment, the positional relationship of the branch point A, the first connection point B, the second connection point C, and the joining point D is merely an example, and the embodiment is not limited thereto. For example, the first connection point B may be positioned further on the upper side than the branch point A in the vertical direction Z, and the joining point D may be positioned further on the right side than the branch point A in the leftward-and-rightward direction X. The first connection point B may be positioned further on the upper side than the second connection point C.

In the above-described embodiment, the first switchback path 214 is not limited to the configuration in which the downstream end of the first switchback path 214 extends to be positioned at the lowermost part in the first switchback path 214. For example, a configuration in which the first switchback path 214 extends being curved so that a part in the middle of the first switchback path 214 is positioned at the lowermost part, may be employed.

In the above-described embodiment, the length of the first branch path 212 and the length of the second branch path 213 may be different from each other. By changing the transport speed by the intermediate transport roller 221, it is possible to reduce a concern that the second paper sheet P2 transported through the intermediate transport path 210 interferes with the previous first paper sheet P1.

In the above-described embodiment, the length of the first joining path 216 and the length of the second joining path 217 may be different from each other. By changing the transport speed by the intermediate transport roller 221, it is possible to reduce a concern that the second paper sheet P2 transported through the intermediate transport path 210 interferes with the previous first paper sheet P1.

In the above-described embodiment, the intermediate transport path 210 provided in the transport apparatus 200 may include a linear path which is connected to the upstream end of the lead-out path 218 from the downstream end of the lead-in path 211. As the paper sheet P is transported through the linear path, since the orientation of transporting the paper sheet P is not reversed, it is possible to lead out the paper sheet P to the post-processing apparatus 300 while maintaining the recording surface to be oriented to the upper side in the vertical direction Z when the simplex printing is performed.

In the above-described embodiment, the branch path 160 and the first discharge path 151 may be configured to be commonly used as one path in the printer 100.

In the above-described embodiment, the third supply path 143 may be configured to extend to pass through the lower side of the recording portion 110 in the vertical direction Z.

The above-described embodiment is not limited to the configuration in which the paper sheet P is supported by using the outer circumferential surface of the belt 135 provided in the belt transport portion 132 as the supporting surface when the recording portion 110 performs the recording on the paper sheet P. For example, a configuration in which a supporting table is provided, and the paper sheet P is supported by using a surface that is an upper side of the supporting table in the vertical direction Z as the supporting surface, may be employed.

The above-described embodiment is not limited to the configuration in which the transport portion 130 which transports the paper sheet P along the transport path 120 is the transport roller pair 131. For example, a configuration in which the transport portion 130 is a conveyor, may be employed.

The above-described embodiment is not limited to the configuration in which the first path forming portion 171 and the second path forming portion 172 rotate around the axis 173. A configuration in which the first path forming portion 171 and the second path forming portion 172 are attachable to and detachable from the pull-out unit 170, may be employed.

In the above-described embodiment, the rising shape of the paper feeding tray 109 is not limited to the shape inclined to rise upward in the vertical direction Z, and may be a shape of rising while being curved.

In the above-described embodiment, it is not necessary to provide a total of two switchback paths, that is, the first switchback path 214 and the second switchback path 215, and the transport apparatus 200 may be configured of only one switchback path.

In the above-described embodiment, the recording system 1000 may be configured of the printer 100 and the post-processing apparatus 300. In other words, the recording system 1000 may not be provided with the transport apparatus 200.

In the above-described embodiment, the recording head 111 provided in the recording portion 110 is not limited to the line head type, and may be a serial head type which can move along the width direction that intersects the transport direction of the paper sheet P.

In the above-described embodiment, the recording apparatus may be a liquid ejecting apparatus which performs the recording by ejecting or dispensing fluid (liquid, a liquid body in which particles of a functional material are dispersed or mixed into the liquid, or a flowing body, such as gel) other than the ink. For example, the recording apparatus may be a liquid body ejecting apparatus which performs the recording by ejecting the liquid body that includes a material, such as an electrode material or coloring material (pixel material), which is used in manufacturing or the like liquid crystal display, electro-luminescence (EL) display, and surface light emission display, by being dispersed or dissolved. In addition, the recording apparatus may be a flowing body ejection apparatus which ejects the flowing body, such as gel (for example, physical gel). In addition, the invention can be employed in any one type of the fluid ejection apparatuses. In addition, the "fluid" in the specification is a concept which does not include fluid made of only gas, and examples of the fluid include liquid (including inorganic solvent, organic solvent, solution, liquid resin, liquid metal (melt metal), and the like), the liquid body, and the flowing body.

The entire disclosure of Japanese Patent Application No.: 2015-066985, filed Mar. 27, 2015, 2015-066986, filed Mar. 27, 2015 and 2015-066987, filed Mar. 27, 2015 are expressly incorporated by reference herein.

What is claimed is:

1. A transport apparatus comprising:

a housing which includes a plurality of paths;

a lead-in path through which a medium is led into the housing;

a first branch path and a second branch path which branch in directions different from each other from a branch point which becomes a downstream end of the lead-in path, in a transport direction in which the medium led in from the lead-in path is transported;

a guiding portion which guides the medium by selectively switching the medium that is transported through the lead-in path to be transported to any one of the first branch path and the second branch path;

a first switchback path which is provided to extend downward in a vertical direction from the downstream end of the first branch path, and in which the medium is switched back;

a second switchback path which is provided to extend downward in a vertical direction from the downstream end of the second branch path, and in which the medium is switched back;

a first joining path through which the medium switched back by the first switchback path is transported;

a second joining path through which the medium switched back by the second switchback path is transported; and a lead-out path which extends from a joining point at which the downstream end of the first joining path and the downstream end of the second joining path join with each other, wherein the lead-out path is provided to pass through between the first switchback path and the second switchback path and extend in order to detour the downstream end of the first switchback path, wherein a first connection point at which an upstream end of the first switchback path and an upstream end of the first joining path are connected to each other is disposed above a second connection point at which an upstream end of the second switchback path and an upstream end of the second joining path are connected to each other in the vertical direction, and wherein a downstream side in the second switchback path is configured of a guide portion provided to extend lower in the vertical direction than the detour portion of the lead-out path.

2. The transport apparatus according to claim 1,
wherein the first connection point is positioned below the branch point in the vertical direction.

3. The transport apparatus according to claim 1,
wherein the lead-in path is provided to diagonally extend to intersect the vertical direction.

4. The transport apparatus according to claim 3,
wherein the lead-in path is provided to include a portion which is above the housing in the vertical direction to penetrate the inside and the outside of the housing.

5. The transport apparatus according to claim 4,
wherein the downstream end of the lead-out path extends toward a side opposite to the side on which the lead-in path penetrates the housing, and the first connection point and the second connection point are positioned near the downstream end of the lead-out path with respect to the branch point.

6. The transport apparatus according to claim 1,
wherein an opening portion is formed at a part of a side wall of the housing.

7. The transport apparatus according to claim 1,
wherein the second switchback path extends to pass through a lower part of a path which is positioned at the lowermost part of the lead-out path, in the vertical direction.

* * * * *